US005359358A

United States Patent [19]

Shimamura et al.

[11] Patent Number: 5,359,358

[45] Date of Patent: Oct. 25, 1994

[54] RECORDING APPARATUS WITH INK JET RECORDING HEAD AND CAPPING DEVICE

[75] Inventors: Yoshiyuki Shimamura, Yokohama; Masasumi Nagashima, Tokyo, both of Japan

[73] Assignee: Canon Kabushiki Kaisha, Tokyo, Japan

[21] Appl. No.: 59,012

[22] Filed: May 24, 1993

Related U.S. Application Data

[63] Continuation of Ser. No. 653,492, Feb. 11, 1991, abandoned.

[30] Foreign Application Priority Data

| | | | |
|---|---|---|---|
| Feb. 13, 1990 | [JP] | Japan | 2-031706 |
| Feb. 19, 1990 | [JP] | Japan | 2-039512 |
| Jul. 20, 1990 | [JP] | Japan | 2-192678 |
| Jul. 20, 1990 | [JP] | Japan | 2-192680 |

[51] Int. Cl.[5] ..... B41J 2/01

[52] U.S. Cl. ..... 347/9; 347/29

[58] Field of Search ..... 346/101, 75, 140; 318/685, 696; 400/903

[56] References Cited

U.S. PATENT DOCUMENTS

| | | | |
|---|---|---|---|
| 4,074,179 | 2/1978 | Kuo et al. | 318/696 |
| 4,176,363 | 11/1979 | Kasahara | 346/140 R |
| 4,313,124 | 1/1982 | Hara | 346/140 R |
| 4,345,262 | 8/1982 | Shirato et al. | 346/140 R |
| 4,368,413 | 1/1983 | Tazaki | 318/687 |
| 4,404,572 | 9/1983 | Okamura et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,602,882 | 7/1986 | Akazawa | 400/322 |
| 4,707,649 | 11/1987 | Kanemura | 318/685 |
| 4,723,129 | 2/1988 | Endo et al. | 346/1.1 |
| 4,734,632 | 3/1988 | Kamikura et al. | 318/685 |
| 4,740,796 | 4/1988 | Endo et al. | 346/1.1 |
| 4,825,231 | 4/1989 | Nozaki | 346/140 R |
| 4,853,717 | 8/1989 | Harmon et al. | 346/140 R |
| 4,967,204 | 10/1990 | Terasawa et al. | 346/1.1 |

FOREIGN PATENT DOCUMENTS

| | | |
|---|---|---|
| 0313204 | 4/1989 | European Pat. Off. . |
| 3633239 | 4/1987 | Fed. Rep. of Germany . |
| 3723954 | 4/1988 | Fed. Rep. of Germany . |
| 3835066 | 4/1989 | Fed. Rep. of Germany . |
| 59-123670 | 7/1984 | Japan . |
| 59-138461 | 8/1984 | Japan . |
| 2211330 | 6/1989 | United Kingdom . |

*Primary Examiner*—Benjamin R. Fuller
*Assistant Examiner*—No Le
*Attorney, Agent, or Firm*—Fitzpatrick, Cella Harper & Scinto

[57] ABSTRACT

A recording apparatus for performing recording on a recording medium with an ink jet recording head capable of ink jetting is described. The recording head is closed by capping after turning off the power source or during waiting or when no data is provided from a host unit for a predetermined period of time. To ensure reliable capping, the position of the carriage carrying the head is recognized. According to the invention, in a case when jumping of teeth occurs in a carriage motor drive system gear due to external disturbance of carriage running, the error that occurs in the carriage position recognition is held within one step so that there is no adverse effect on the capping executed during non-recording time such as when recording is ended or when absorbing recovering is executed.

30 Claims, 23 Drawing Sheets

FIG. 21

| n th PHASE / N th PHASE | 1st PHASE | 2nd PHASE | 3rd PHASE | 4th PHASE | 5th PHASE | 6th PHASE | 7th PHASE | 8th PHASE |
|---|---|---|---|---|---|---|---|---|
| 1st PHASE | 0 | 1 | 2 | 3 | X | -3 | -2 | -1 |
| 2nd PHASE | -1 | 0 | 1 | 2 | 3 | X | -3 | -2 |
| 3rd PHASE | -2 | -1 | 0 | 1 | 2 | 3 | X | -3 |
| 4th PHASE | -3 | -2 | -1 | 0 | 1 | 2 | 3 | X |
| 5th PHASE | X | -3 | -2 | -1 | 0 | 1 | 2 | 3 |
| 6th PHASE | 3 | X | -3 | -2 | -1 | 0 | 1 | 2 |
| 7th PHASE | 2 | 3 | X | -3 | -2 | -1 | 0 | 1 |
| 8th PHASE | 1 | 2 | 3 | X | -3 | -2 | -1 | 0 |

RECORDING APPARATUS WITH INK JET RECORDING HEAD AND CAPPING DEVICE

This application is a continuation of application Ser. No. 07/653,492 filed Feb. 11, 1991, now abandoned.

BACKGROUND OF THE INVENTION

1. Field of the Invention

This invention relates to a recording apparatus with an ink jet recording head.

2. Related Background Art

There have been proposed various recording apparatuses for performing recording on recording media such as paper and OHP sheet (hereinafter referred to as recording paper or merely as paper). Such recording apparatuses have a recording head mounted on them and are of various recording systems, such as wire dot system, heat-sensitive system, heat transfer system and ink jet system.

Among these recording systems, there is an ink jet recording system. This system jets ink directly onto recording paper. Therefore, its running cost is inexpensive, and it is noted as a guiet recording system.

A recording apparatus which is based on such ink jet system generally uses a recording head having an arrangement of minute discharging orifices for jetting ink therefrom. Therefore, to cope with a case when ink becomes inadequate for jetting or recording due to such cause as intrusion of air bubbles or dust inwardly from such discharging orifices or viscosity increase of ink resulting from evaporation of ink solvent, it is a practice to flush the ink to remove these causes of defective jetting or discharging of ink (the process being referred to as jetting recovering process).

As one form of means for carrying out such jetting recovering process, there is a system, in which a cap capable of covering an orifice-formed face of a recording head and a pump in communication with the cap and providing an absorbing force thereto are provided. Ink-discharging energy generating elements are provided inside the discharging orifices and are driven to cause discharge of ink from all the discharging orifices to the cap (hereinafter the process being referred to as preliminary discharge). Also, they are driven to provide an absorbing force with the orifice-formed face closed by the cap, thus absorbing ink from the discharging orifices and thereby causing forced discharge of ink. In the above way, causes of defective discharge are removed along with ink (hereinafter the process being referred to as absorption recovering).

Further, in order to avoid adverse effects of dust or the like that are produced when the recording head is exposed to air by opening the cap, it is in practice to have the head closed with the cap after the power source is turned off or during waiting or when no data is provided from a host unit for a predetermined period of time (hereinafter the process being referred to as capping). This capping is liable to apply a pressure to the recording head to thereby move a carriage carrying the head. For this reason, it is necessary to open the cap after capping and effect position recognition, i.e., recognize the position of the carriage, when operating the carriage.

If the recognition of carriage position is not effected, it leads to failure of alignment of the discharging orifice position of the recording head, i.e., position of the carriage carrying the head, and position of the cap in the event of deviation of the carriage when it is intended to cap the discharge orifices. In such case, capping can not be effected, thus leading to such deficiencies as defective discharge of ink due to viscosity increase thereof or intrusion of dust or inability of ink absorption through the cap at the time of absorption recovery.

Thus, in the ink jet recording apparatus, it is very important to recognize the carriage position accurately in order to maintain the performance of the recording head for long time.

Heretofore, for recognizing the carriage position, a detection signal indicating that the carriage has passed by a particular position is recognized, and the recognition of position is effected with reference to the position corresponding to the recognition of the detection signal. In addition, for the recognition of the carriage position the detection signal is recognized once at the time of the closure of the power source, then the phase of exciting a stepping motor driving the carriage at this time is stored as reference position data, and subsequent recognition of the carriage position is effected through correction of the exciting phase of the stepping motor at the time of recognition of the detection signal provided when the particular position is subsequently passed by the carriage in comparison to the exciting phase stored as reference position data noted above.

In the former case, however, an error of one step is produced in the position recognition. Therefore, in case when capping is effected during recording, deviation by one line is liable to occur between the recording of upper line and that of lower line. In the latter case, no such error is produced owing to the correction according to the reference position data. However, although there is no problem so long as the carriage is run smoothly, in the event of occurrence of jumping of teeth of a motor drive system due to disturbance of the running of the carriage caused by external factors (such as jamming of paper), the stored reference position data becomes meaningless. Rather, in this case there is a possibility of increase of error in the carriage position recognition.

In a further aspect, in the recording apparatus of the type noted above, after the carriage is moved to the cap position, the output of the exciting phase of the drive motor, i.e., stepping motor, is stopped.

In such state without stepping motor exciting phase output, the carriage is freely movable by external forces. Therefore, when effecting capping with respect to the recording head mounted on the carriage, failure of moving the cap to a desired capping position is liable due to slight displacement of the carriage.

To overcome this drawback, it may be thought to secure the carriage in position by bringing the carriage into contact with a positioning member provided outside the recording zone and providing an urging force in this direction from a motor at all times. Doing so, however, produces a great load on the motor, giving rise to rupture of the motor and also consuming great power.

In a further aspect, an error in the position of the recording head is liable to be produced due to defectiveness of a detector for carriage position control or assembling errors of machine. In such cases, there will result a failure of alignment of the ink discharging orifice position of recording head, i.e., position of the carriage carrying the head, and cap position. This disables capping.

In this case, there are produced such deficiencies such as defective discharge of ink due to ink viscosity increase or introduction of dust.

SUMMARY OF THE INVENTION

An object of the invention is to provide a recording apparatus, which permits reliable capping of its ink jet recording head.

Another object of the invention is to provide a recording apparatus, in which even if jumping of teeth occurs in gears of carriage motor drive system due to disturbance of carriage running caused by an external factor (such as jamming of paper), the error in the carriage position recognition can be held within one step so that there is no adverse effect on the capping of the recording head executed during non-recording time such as when recording is ended or when absorbing recovering is executed.

A further object of the invention is to provide a recording apparatus, in which when capping is executed during recording, it can be reliably effected without deviation of recording of upper line and that of lower line from each other.

A still further object of the invention is to provide a recording apparatus using an ink jet recording head, which consumes less power, is free from damage to carriage drive motor and ensures accurate positioning and satisfactory recovery operation.

A yet further object of the invention is to provide a recording apparatus, which permits reliable capping even if there is mechanical or electric errors in the position of the ink jet recording head.

To attain the above object of the invention, there is provided a recording apparatus for performing recording on a recording medium with an ink jet recording head capable of ink jetting comprising:

a cap capable of covering a face of said recording head formed with orifices for jetting ink therefrom;

a stepping motor rotatable according to supplied exciting phase to drive a carriage carrying said recording head;

detecting means for detecting reaching of a predetermined position by said carriage driven with rotation of said stepping motor;

memory means for storing as reference exciting phase a phase, with which said stepping motor is excited when a detection signal is provided from said detecting means;

first position recognition means for recognizing the position of said carriage through comparison of the exciting phase of said stepping motor and reference exciting phase stored in said memory means when said detection signal is provided during a recording period of said recording head; and second position recognition means for recognizing the position of said carriage not on the basis of said stored reference exciting phase when said detection signal is provided in case when said recording head is covered by said cap during a non-recording period of said recording head.

To the same end, there is also provided a recording apparatus for forming a recorded image on a recording medium with an ink jet recording head capable of ink jetting comprising:

a support member supporting said recording head and capable of scanning;

a stepping motor for scanning said support member;

a cap member capable of covering a face of said recording head formed with discharging orifices for jetting ink therefrom;

cap member moving means for moving said cap member between a put-on position and a separated position with respect to said orifice-formed face of said recording head, said cap member moving means including a first engagement member capable of engaging with a second engagement member provided on part of said support member, said first and second engagement members being engaged with each other in a state with said cap member put on and covering said orifice-formed face of said recording head; and stepping motor control means for stopping the output of the exciting phase of said stepping motor in a state of engagement of said first and second engagement members with each other.

To the same end, there is further provided a recording apparatus for performing recording on a recording medium with an ink jet recording head capable of ink jetting comprising:

a cap capable of covering a face of said recording head formed with discharging orifices for jetting ink therefrom;

a first engagement member formed such as to be interlocked to said cap;

a second engagement member formed on said recording head for engagement with said first engagement member when said orifice-formed face of said recording head is covered by said cap; and drive means for causing swinging of said recording head after an operation of putting on said cap.

BRIEF DESCRIPTION OF THE DRAWINGS

FIG. 21 is a correction table used in the system;

DETAILED DESCRIPTION OF THE PREFERRED EMBODIMENTS

Now, an embodiment of ink jet recording apparatus according to the invention will be described with reference to the drawings.

Figure 1A:
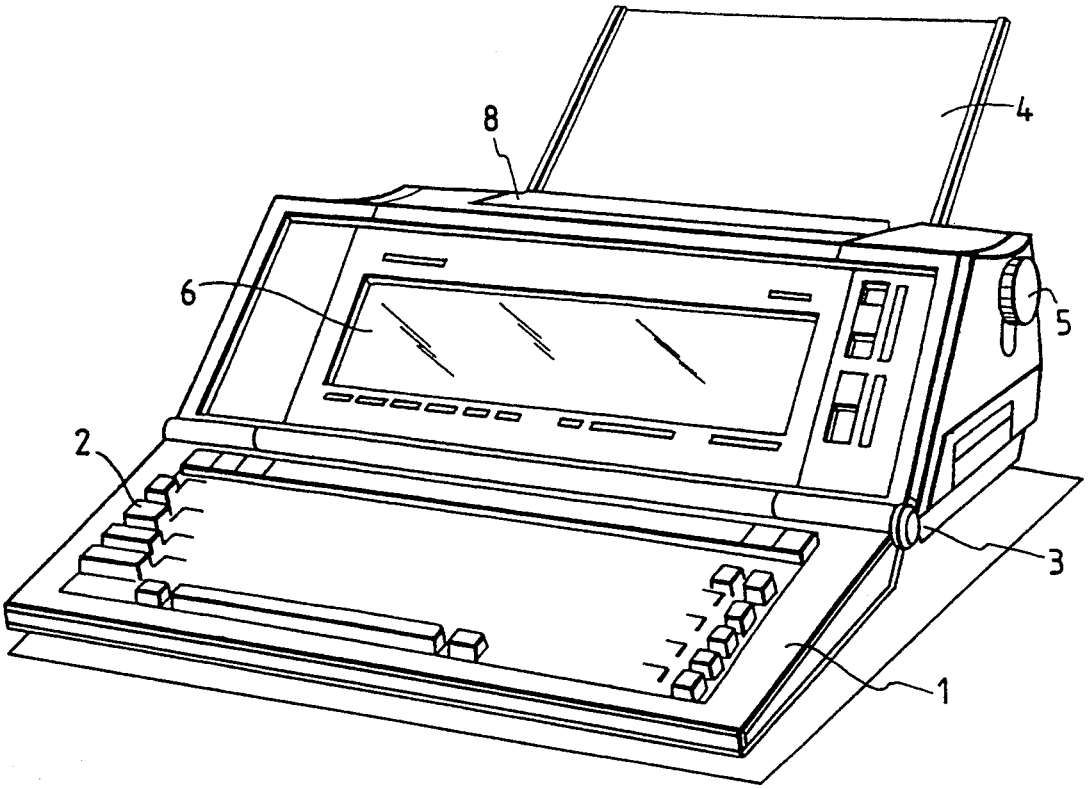
FIGS. 1A and 1B are perspective views showing an embodiment of the invention applied to a document processing system, in use and in storage, respectively.
Figure 1B:
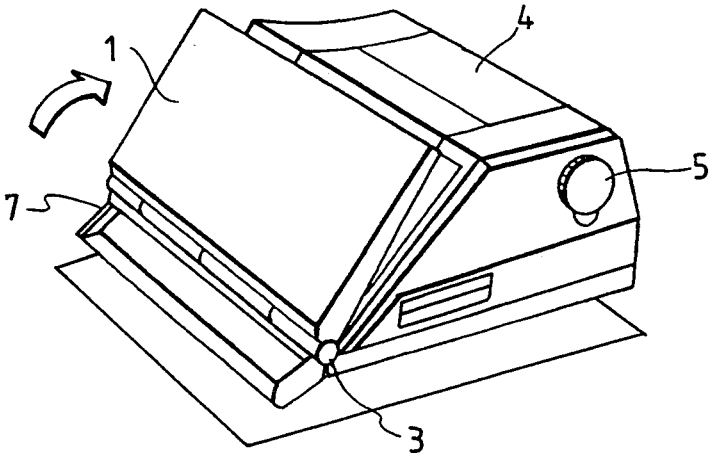

FIGS. 1A and 1B show an example of the construction of the embodiment of the invention applied to a document processing system.

Referring to the Figures, designated at 1 is a keyboard unit. Unit 2 has keys for inputting characters and numerical figures and also control keys, these keys being arranged in key array 2, and when it is not used it can be folded about hinge 3 to a state as shown in FIG. 1B. Designated at 4 is a feed tray for feeding sheet-like recording medium into printer unit 8 provided inside the apparatus. When keyboard unit 1 is folded after use, it covers printer unit 8 as shown in FIG. 1B. Designated at 5 is a feed knob for manually setting and discharging recording medium, at 6 is a display for displaying input document or the like, and at 7 is a grip which may be used when transporting the apparatus in this embodiment.

Figure 2:
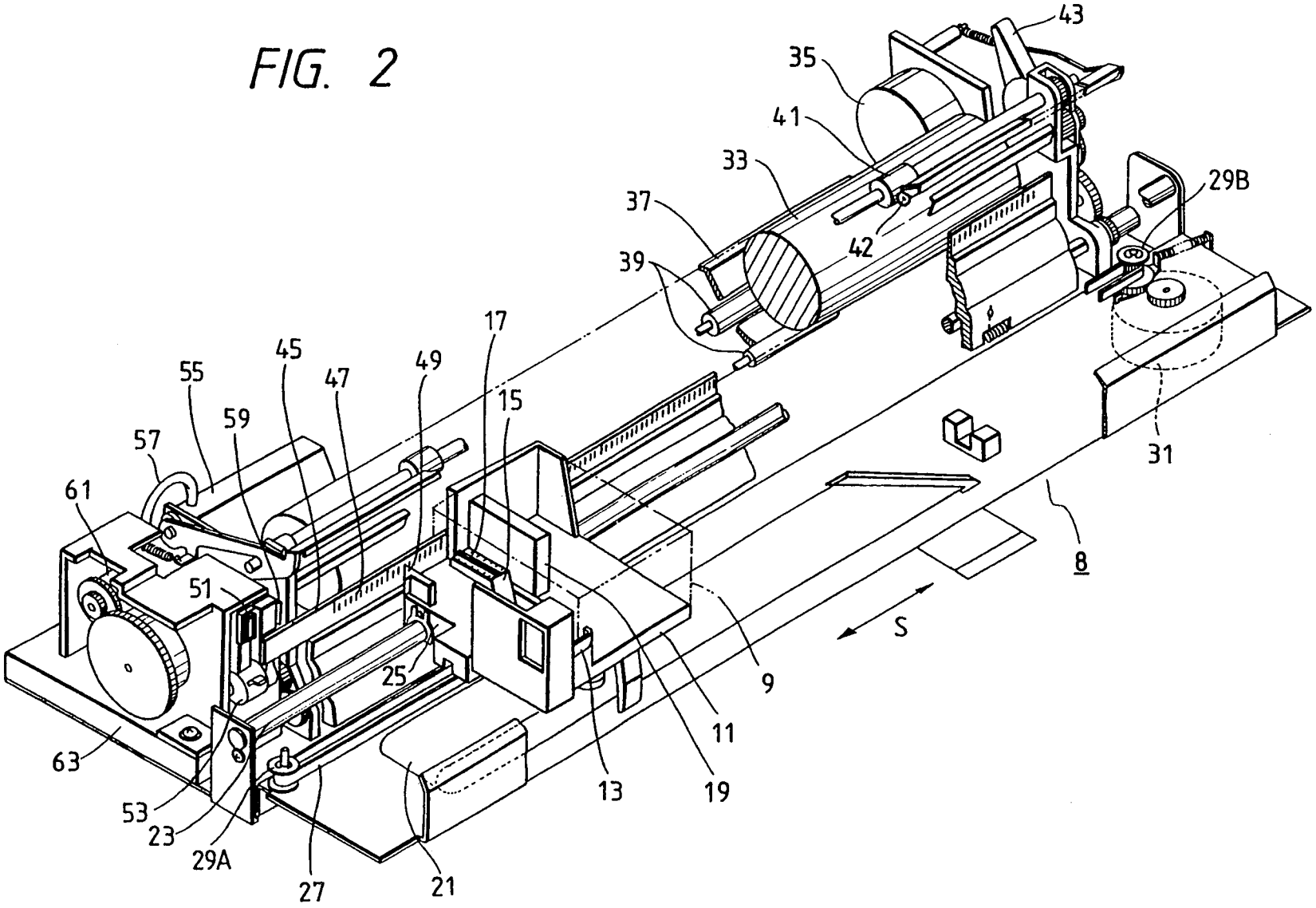
FIG. 2 is a perspective view showing an example of printer capable of use according to the invention.

FIG. 2 shows an example of construction of printer unit 8 in this embodiment.

Referring to the Figure, designated at 9 is a head cartridge having an ink jet recording head as will be described later in detail with reference to FIGS. 3 and 4, and at 11 a carriage carrying the cartridge and scanning in directions S. Designated at 13 is a hook for mounting head cartridge 9 on carriage 11, and at 15 is a lever for operating hook 13. Lever 15 has marker 17, which can mark a scale provided on a cover to be described later to permit reading of printing position, set position, etc. occupied by the recording head of the head cartridge. Designated at 19 is a support plate supporting an electric connection section with respect to head cartridge 9. Designated at 21 is a flexible cable for connecting the electric connection section and control unit of the machine body.

Designated at 23 is a guide shaft for guiding carriage 11 in directions S. The guide shaft penetrates bearing 25 of carriage 11. Designated at 27 is a timing belt, to which carriage 11 is secured, and which transmits power for moving carriage 11 in directions S. The timing belt is passed round pulleys 29A and 29B provided on opposite sides of the apparatus. Drive force is transmitted to one of pulleys, i.e., pulley 29B, from carriage motor 31 via a transmitting mechanism including gears.

Designated at 33 is a platen roller for regulating the recording surface of paper or like recording medium (hereinafter referred to as recording paper) and feeding recording paper when recording or like is performed. Designated at 37 is a paper pan for leading recording medium from feed tray 4 to a recording position, and at 39 is a feed roller, which feeds recording medium by urging the medium against platen roller 33. Designated at 41 is a discharging roller, which is provided ahead of the recording position of recording medium in the feeding direction thereof for discharging the medium toward a discharging opening (not shown). Designated at 42 is a roller facing discharging roller 41 and serving to urge roller 41 via recording medium to produce a force, with which the recording medium is fed by discharging roller 41. Designated at 43 is a release lever for releasing the bias of feed roller 39, keep plate 45 and roller 42 when setting recording medium or in like case.

Designated at 45 is keep plate disposed in the neighborhood of the recording position and serving to suppress floating-up of recording medium and ensure close contact state thereof with platen roller 33. In this embodiment, an ink jet recording head is used, which can jet ink for recording. Therefore, the distance between the orifice-formed face of the recording head and recording surface of the recording medium has to be comparatively small and controlled stringently to avoid contact between the recording medium and orifice-formed face. To this end, disposition of keep plate 45 is effective. Designated at 47 is a scale provided on keep plate 45. Carriage 11 is provided with marker 49 which opposes scale 47. This arrangement also permits reading of the printing position and set position of the recording head.

Designated at 51 is a cap, which is made of an elastic material such as rubber and faces the orifice-formed face of the recording head in its home position. The cap is supported such that it can be brought into contact with and separated from the recording head. It can be used for protection of the head in a non-recording period or when carrying out an operation of jetting recovering of the head. By the term "operation of jetting recovering" is meant a process of causing ink to be jetted from all the discharging orifices by driving energy generating elements disposed inside the orifices and utilized for ink jetting, thereby removing causes of defective jetting such as introduced air bubbles and dust and ink with increased viscosity and no longer suited for recording, or a process of forced discharging of ink from the discharging orifices executed independently of the first-mentioned process for removal of causes of defective jetting.

Designated at 53 is a pump, which provides an absorbing force for forced discharging of ink and is used for absorbing ink received in cap 51 in a jetting recovering process through such forced discharging or through preliminary jetting. Designated at 55 in a waste ink tank for storing waste ink absorbed by pump 53, and at 57 is a tube communicating pump 53 and waste ink tank 55 with each other.

Designated at 59 is a blade for performing wiping of the orifice-formed face of the recording head. The blade is supported for movement between a position to project to the recording head side to effect wiping during movement of the head and a retreated position out of engagement with the orifice-formed face of the recording head. Designated at 61 is a recovering system motor, and at 63 is a cam unit for effecting the driving of pump 53 and movement of cap 51 and plate 59 by receiving force transmitted from recovering system motor 61.

Head cartridge 9 noted above will now be described in detail.

Figure 3:
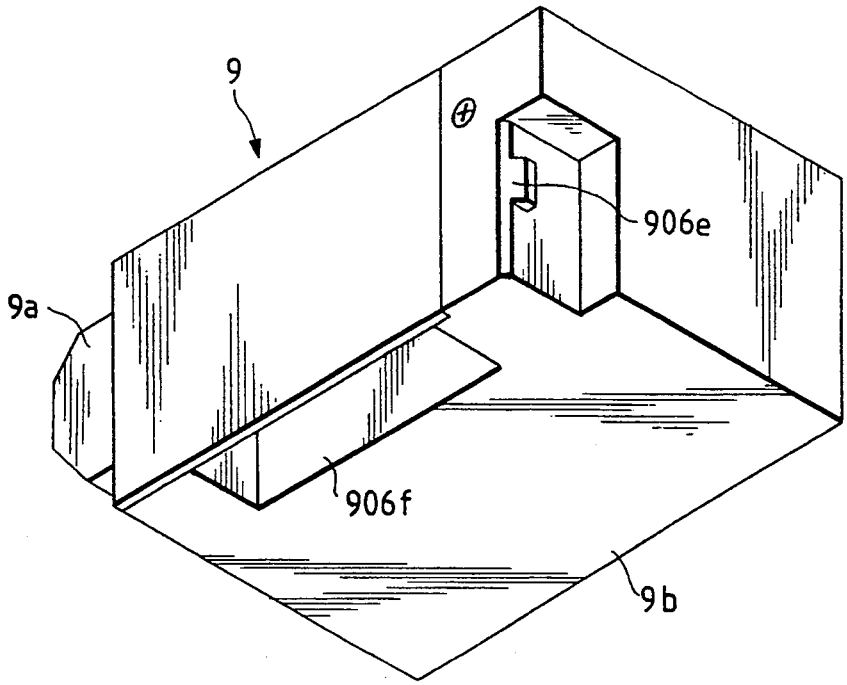
FIG. 3 is a perspective view showing a head cartridge shown in FIG. 2.

FIG. 3 is a perspective view showing head cartridge 9 constituting an ink jet recording head body and integrally including ink jet unit 9*a* and ink tank 9*b*. Referring to the Figure, designated at 906*e* is a pawl which is locked by hook 13 provided on carriage 11 when mounting head cartridge 9. As is clearly shown, pawl 906*e* is disposed on the inner side of the extension of the recording head. Further, a striker (not shown) for positioning is provided on head cartridge 9 in the neighborhood of forward jet unit 9*a*. Designated at 906*f* is a head recess, into which is inserted a support plate erected from carriage 11 and supporting a flexible circuit board (i.e., electric connection section) and rubber pad.

Figure 4B:
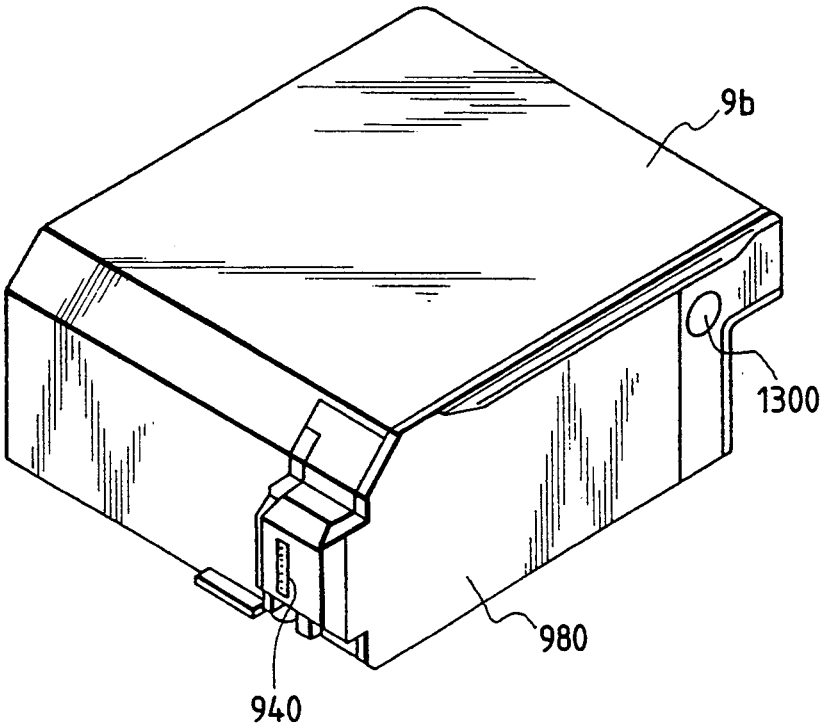
FIGS. 4A and 4B are an exploded perspective view and a perspective view, respectively, showing the head cartridge shown in FIG. 3.
Figure 4A:
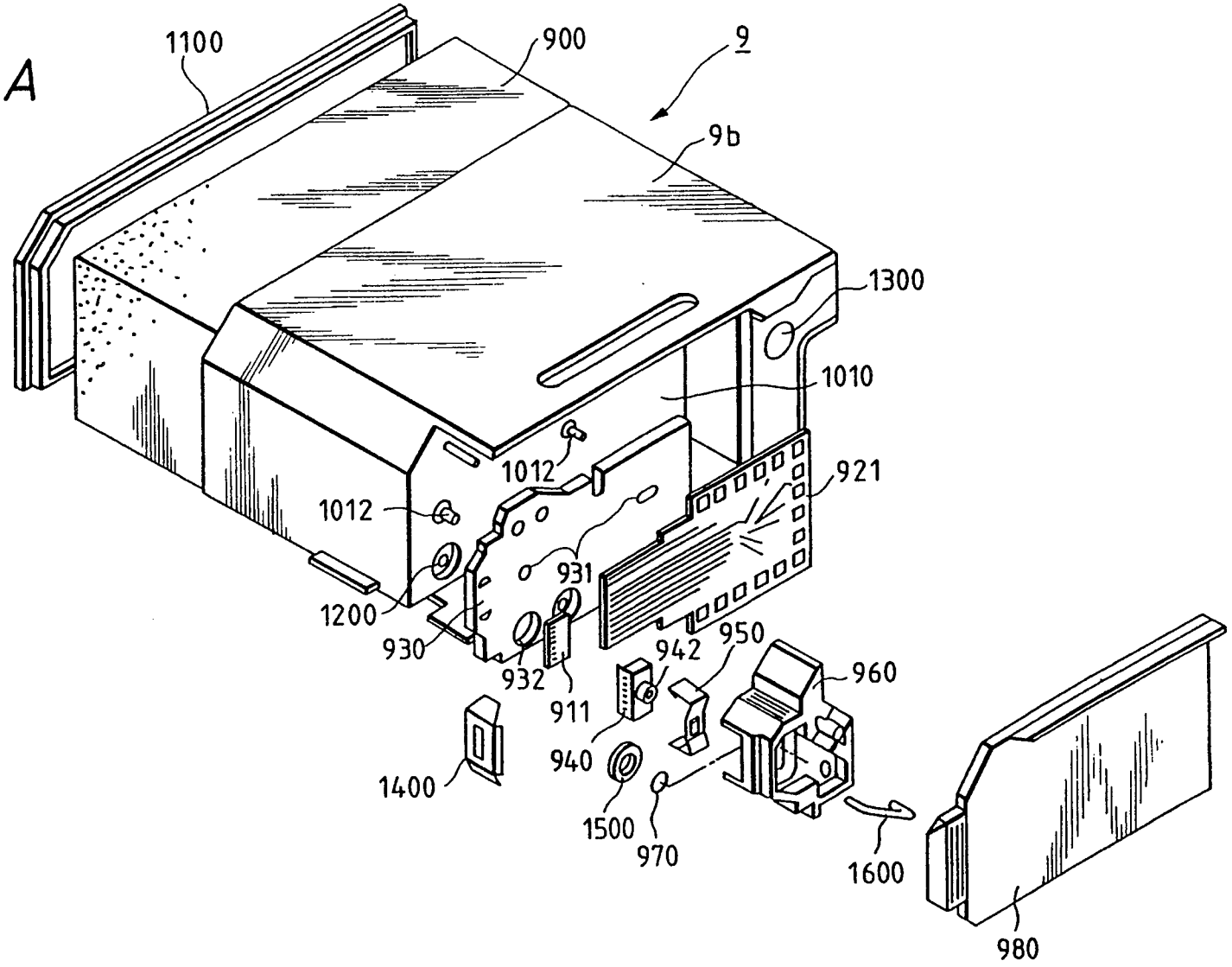

FIGS. 4A and 4B are perspective views showing the head cartridge shown in FIG. 3. As noted above, the head cartridge is of a disposable type integrally including an ink source and an ink accommodating section.

Referring to FIG. 4A, designated at 911 is a heater board including an electricity-heat converter (i.e., jetting heater) and lead of aluminum or like material for supplying power to the element, the element and lead being formed by thin film techniques on a silicon substrate. Designated at 921 is a wiring board corresponding to heater board 911, with corresponding leads connected to one another by wire bonding for instance.

Designated at 940 is a ceiling plate provided with partitioning walls defining ink paths and a common ink chamber. In this embodiment, the ceiling plate is made of a resin material and integrally includes an orifice plate portion.

Designated at 930 is a support member made of a metal, for instance, and at 950 is a retainer spring. Heater board 911 and ceiling plate 940 are engaged with each other in a state sandwiched between support member 930 and retainer spring 950, and they are urgedly secured to each other by the biasing force of retainer spring 950. Support member 930 may include wiring board 921 provided by bonding or the like and have a reference of positioning with respect to carriage 11 for head scanning. Further, it may function as well as heat radiating member to radiate heat produced in heater board 911 by driving and thus cooling the board.

Designated at 960 is a supply tank, which is supplied with ink from ink reservoir 9*b* constituting the ink source and leads the supplied ink to common ink chamber defined by the bonding between heater board 911 and ceiling plate 940. Designated at 970 is a filter disposed in supply tank 960 and near an ink supply port leading to the common ink chamber, and at 980 a lid member covering the supply tank 960.

Designated at 900 is an absorbing member for being impregnated with ink. This member is disposed in ink tank body 9*b*. Designated at 1200 is a supply port, through which ink is supplied to recording element 9*a* consisting of elements 911 to 980. Absorbing member 900 may be impregnated with ink by injecting ink from supply port 1200 in a step prior to disposing the unit in part 1010 of ink tank body 9*b*.

Designated at 1100 is a lid member of the cartridge body, and at 140 is an atmosphere communication port provided in the lid member for communicating the cartridge interior to atmosphere. Designated at 1300 is a repelling member disposed inside atmosphere communication port 1400 to prevent leakage of ink from atmosphere communication port 1400.

After charging of ink into ink tank 9*b* through supply port 1200 has been completed, jetting unit 9*a* consisting of parts 911 to 980 is disposed in part 1010. The positioning or securing at this time can be done by engaging projection 1012 of ink tank body 9*b* and corresponding hole 931 in support member 930, and by so doing head cartridge 9 shown in FIG. 4B is completed.

Ink is supplied from the cartridge inside through supply port 1200, hole 932 formed in support plate 930 and an inlet port provided on the back side of supply tank 960 shown in FIG. 4A into supply tank 960, and thence it flows through an outlet port, a suitably provided supply ductline and ink inlet 942 of ceiling plate 940 into the common ink chamber. In the above ink path, connecting sections are provided with packings of, for instance, silicone rubber, butyl rubber and so forth to provide sealing and ensuring the ink supply path.

A mounting/dismounting operation mechanism is constituted by operating lever 15, hook 13 and other members. It is provided on the side of carriage 11, i.e., on the moving direction side thereof, and therefore it will never define a great dead space with movement of the carriage.

Now, the striker for positioning when mounting the head cartridge will be described.

Designated at 601*a* are striking portions for positioning in transversal directions. They are provided at two side positions of striker 607. In addition to striking portions 601*a* further striking portion 601*f* which is provided on the support plate is utilized for positioning in transversal directions.

Designated at 601*b* are striking portions for positioning in longitudinal or back-and-forth directions. These portions are formed in lower side portions of striker 607.

Designated at 601*c* are striking portions for positioning in vertical directions. These portions are formed at two positions, i.e., on a lower side portion of striker 607 and a lower side portion of the support plate.

Figure 5A:
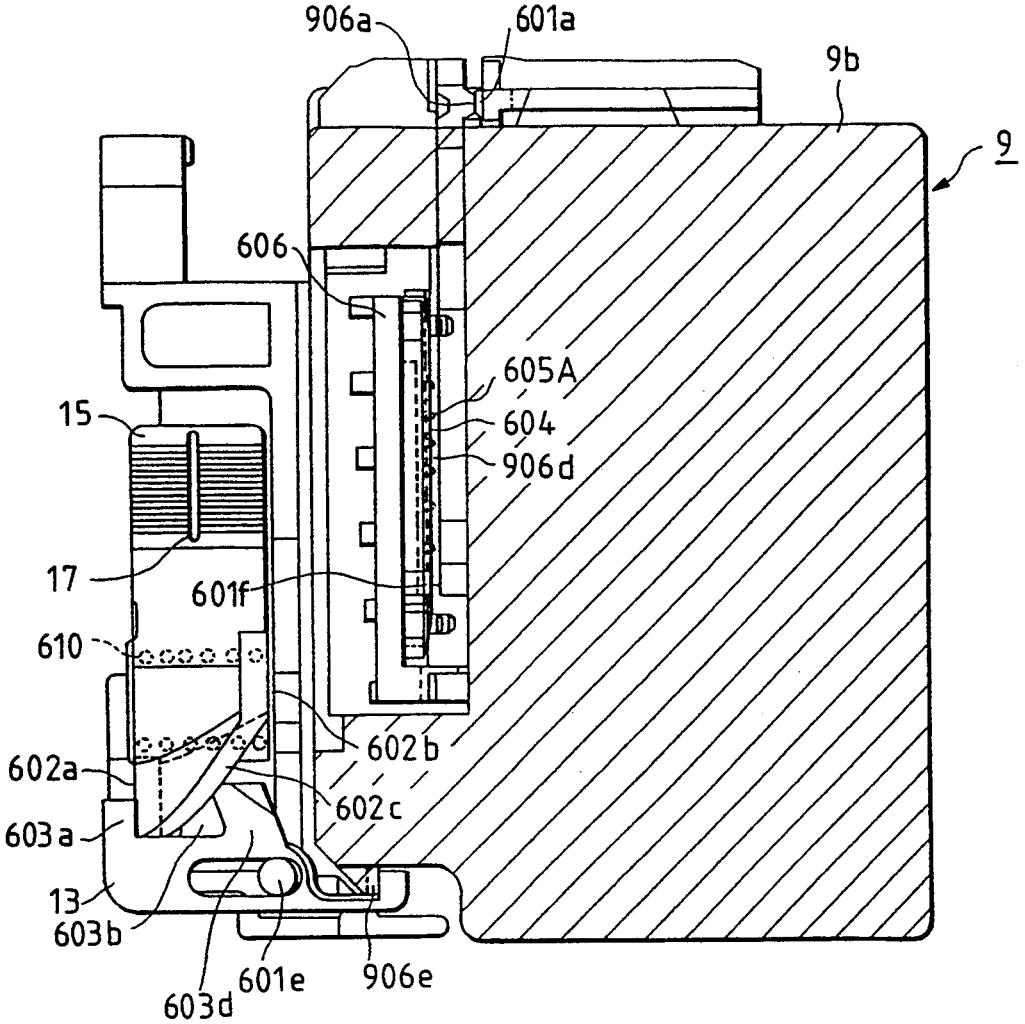
FIGS. 5A and 5B are a top view and a side view, respectively, showing the same head cartridge mounted on a carriage.
Figure 5B:
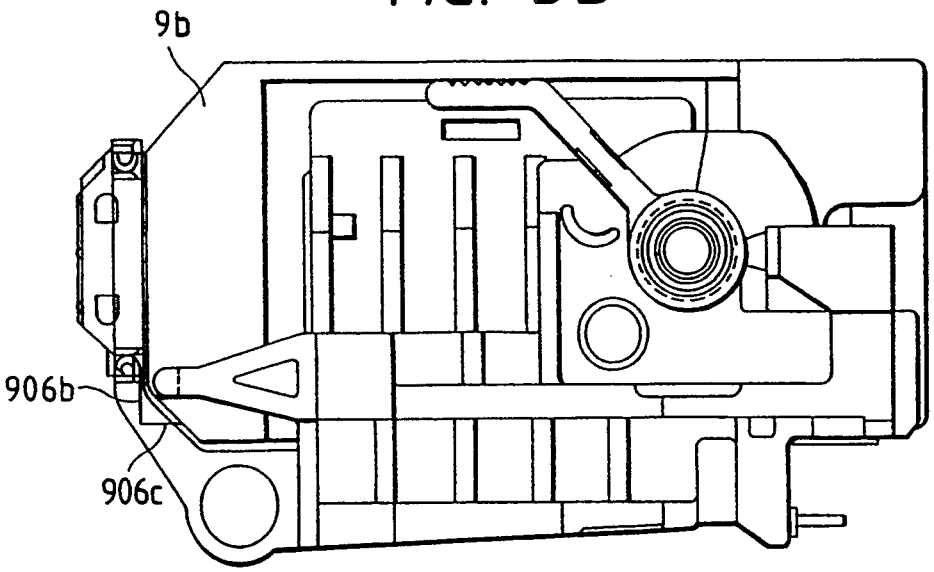

FIGS. 5A and 5B are a top view and a left side view, respectively, showing carriage 11 and head cartridge 9 mounted thereon.

Referring to these Figures, designated at 906*a* is an engagement portion provided on head cartridge 9 such as to be able to engage striking portions of carriage 11 when mounting the recording head, and at 906*b* and 906*c* are engagement portions similarly corresponding to respective striking portions 601*b* and 601*c*.

Now, coupling relation of various parts when the recording head is mounted will be described with reference to FIG. 5A.

Engaging portion 906*a* of head cartridge 9 is in engagement with striking portion 601*a* of carrier 6, and at the same time pawl 906 of head cartridge 9 receives a leftward force in the Figure due to a biasing force of coil spring 610 via hook 13 locked by it. Head cartridge 9 thus receives a moment about the engagement portion noted above. At this time, board 906*a* provided on the head is brought into engagement with striking portion 601*f*, and thus head cartridge 9 is positioned in transversal directions and is held at that position.

At this time, projection 605A of rubber pad 605 is compressed and deformed as it engages with board 906*d*. This deformation produces a force to have a terminal pad of flexible substrate 604 and terminal of substrate 906*d* in forced contact with each other. At this time, striking portion 601*f* is in contact with board 906*d*, and thus projection 605A is deformed to a constant extent, thus obtaining the urging force noted above stably.

There is no showing of a compressedly deformed state of projection 605A.

The positioning of head cartridge 9 in back-and-force and vertical directions is done while the recording head is mounted.

Figure 6:
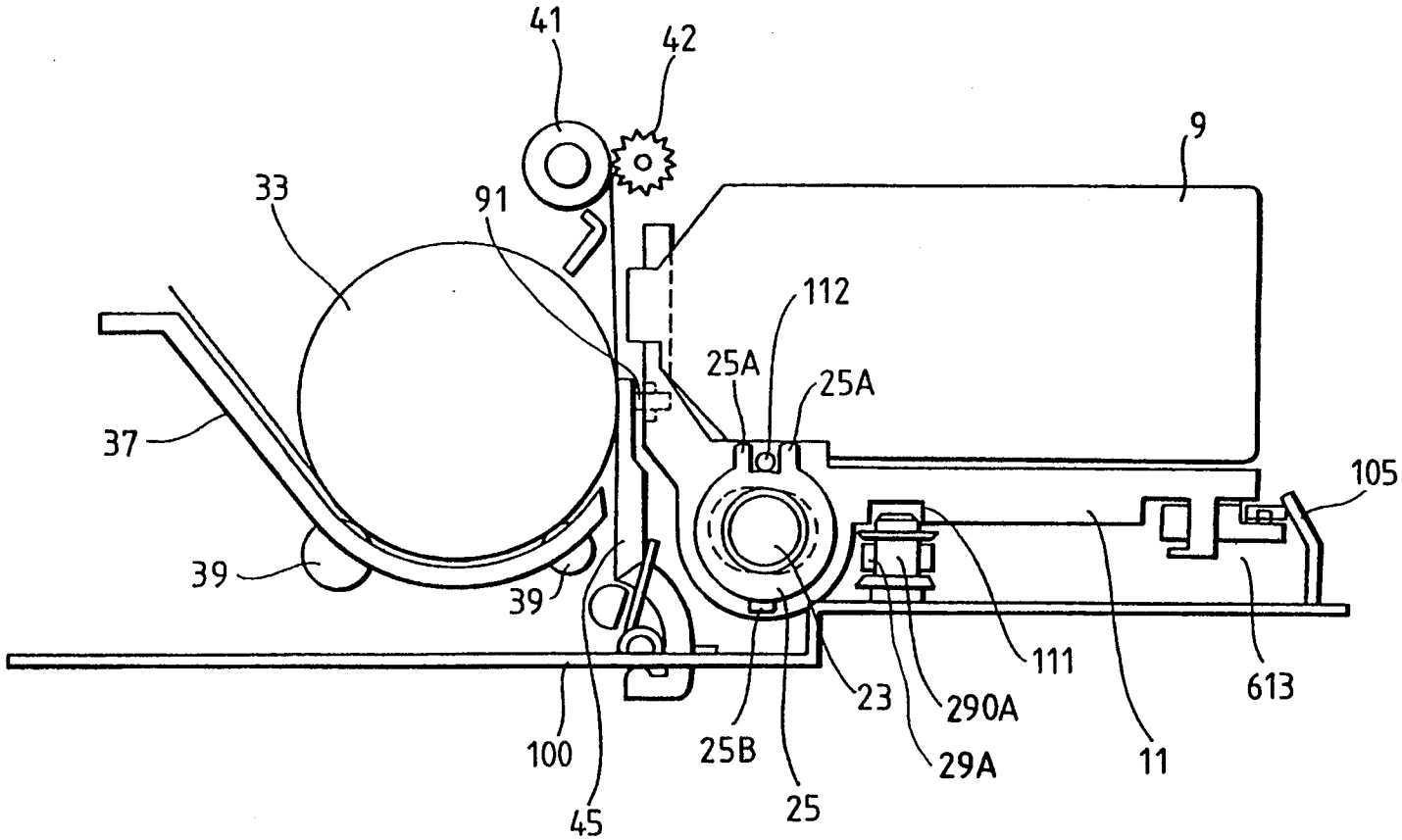
FIGS. 6 and 7 are a side view and a top view, illustrating coupling relation of the carriage shown in FIG. 2 and so forth to other elements.
Figure 7:
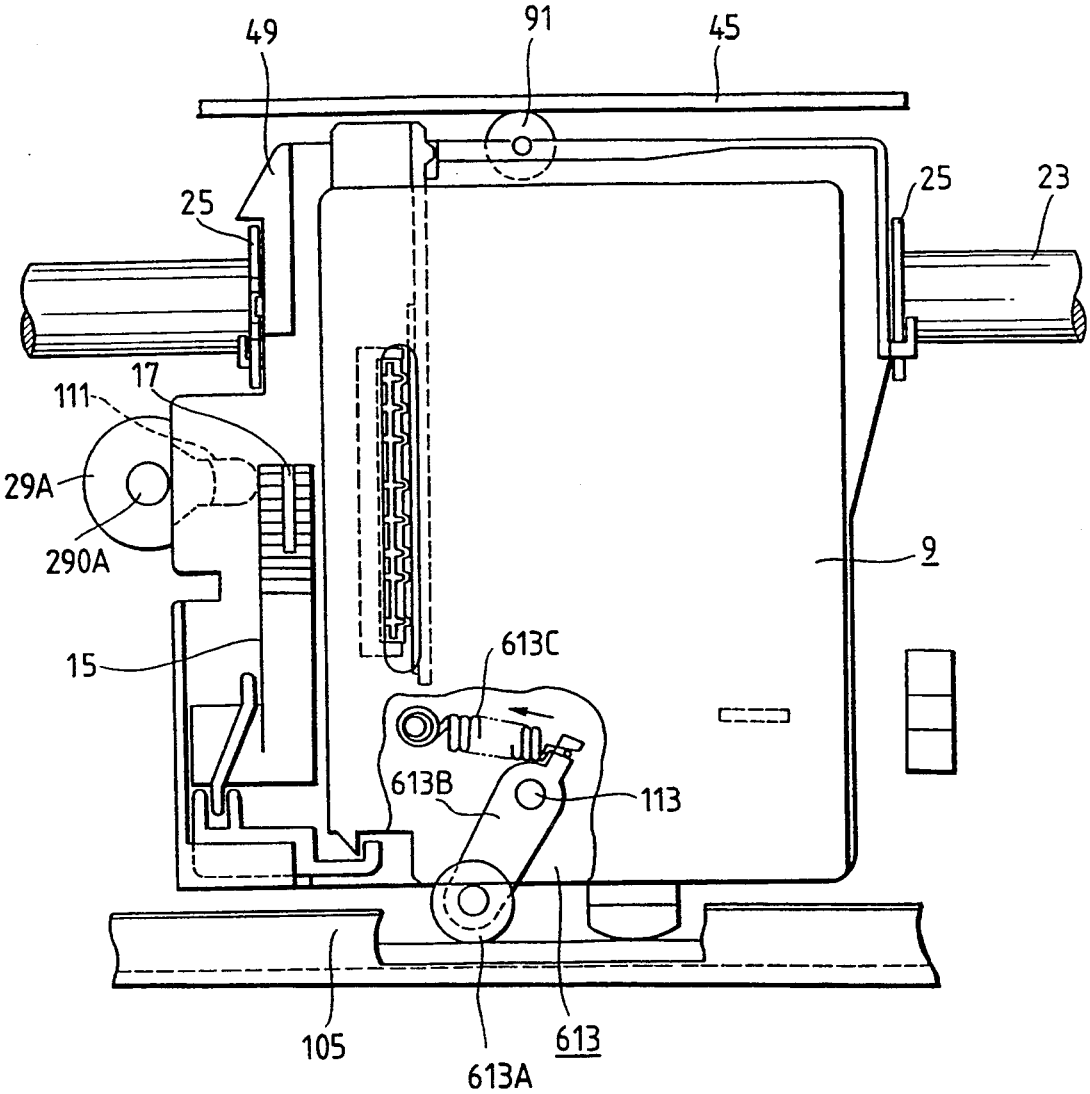

FIGS. 6 and 7 are a side view and a top view, respectively, showing mechanisms around the head cartridge shown in FIG. 2 and so forth.

Referring to these Figures, designated at 91 is a roller rotatably mounted on a front end portion of carriage 11. Roller 91 is provided such that it partly projects forwardly from the orifice-formed face of the head cartridge. The roller is in engagement with and rolls over paper keep plate 45. Designated at 613 is a roller spring provided at the rear end of carriage 11. Roller spring 613 consists of roller 613A, coupling member 613B rotatably supporting roller 613A and spring 613C for biasing coupling member 613B in a predetermined rotational direction. Roller 613A engages with and rolls over front end plate 105 erected from the front end portion of bottom plate 100 to extent parallel to the guide shaft noted above. Coupling member 613B is rotatably supported on predetermined shaft 113 of carriage 11. Spring 613C is supported on a predetermined shaft of carriage 11 and biases coupling member 213B about shaft 113 in the counterclockwise direction. By the above construction of roller spring 613, carriage 11 is biased at all time toward paper keep plate 45.

Designated at 25 are bearings coupled to guide shaft 23. They are each mounted on each side end portion of carriage 11. Bearings 25 have bearing portions eccentric with respect to case of the apparatus. Two bearings 25 are mounted such that they are eccentric in opposite directions. Bearing 25 on the side shown in FIG. 6 is pivotable about boss 112 provided on carriage 11. Carriage 11 has a slot formed in a portion, in which bearing 25 is mounted. Movement of two projections 25A is restricted in back-and-forth directions (i.e., transversal directions in FIG. 6). Thus, with movement of carriage 11 bearing 25 is rocked relative to carriage 11. Movement of bearing 25 in the direction of guide shaft 23 is restricted as projection 25B provided on shaft 25 is restricted by part of carriage 11.

Figure 8:
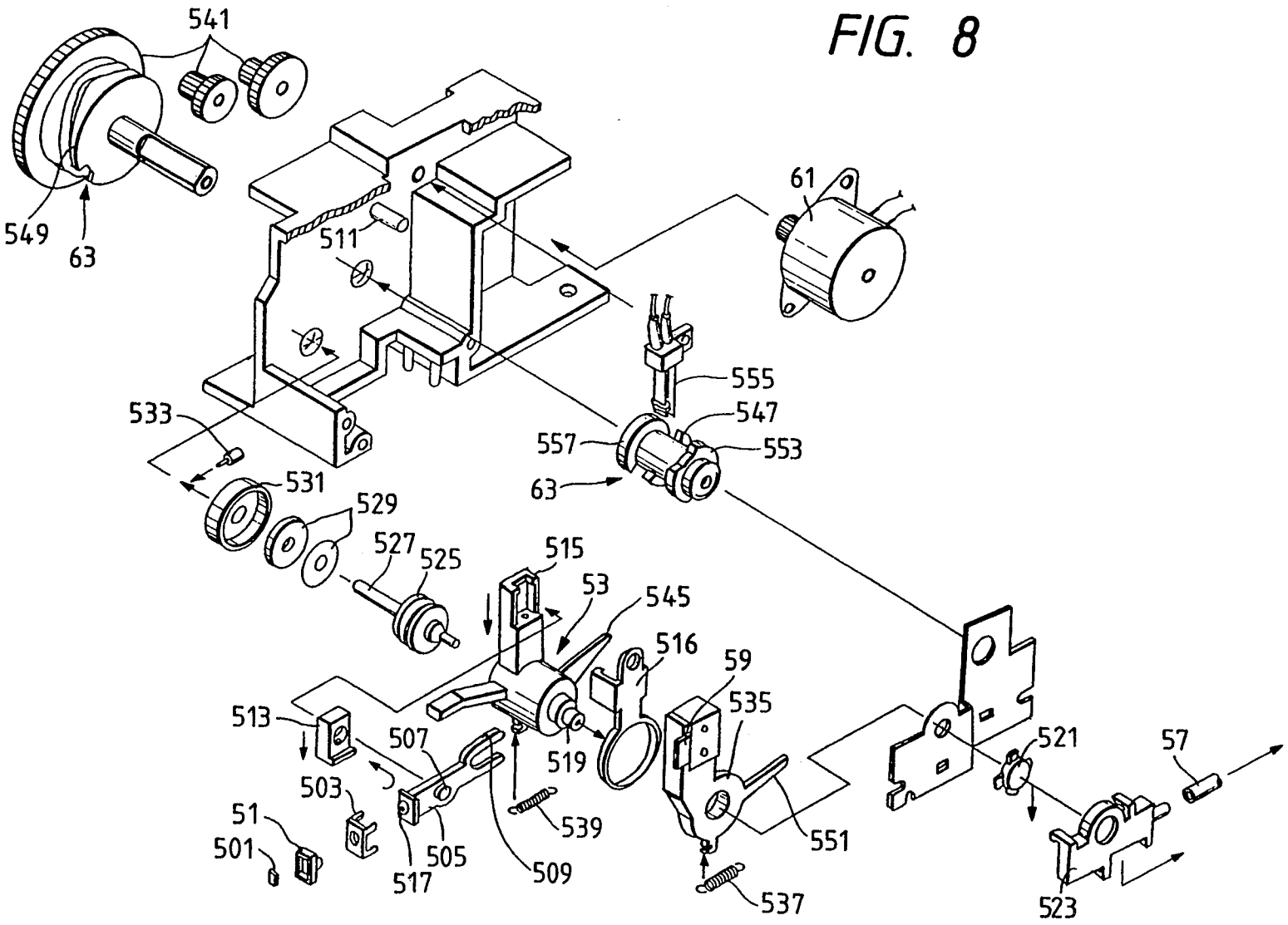
FIG. 8 is an exploded perspective view showing a discharging recovering mechanism.

FIG. 8 is an exploded perspective view showing an essential part of the jetting recovering unit consisting of cap 51, pump 53, plate 59, motor 61, cam unit 63 and so forth shown in FIG. 2.

Referring to FIG. 8, designated at 501 is an ink absorber provided inside cap 51, at 503 is a holding member holding cap 51, and at 505 is a cap lever, which is rotatably mounted for rotation about pin 507 for engaging and disengaging cap 51 with respect to the orifice-formed face of jet unit 9*a*. Designated at 511 is a pin engaged with end 509 of cap lever 505 to define a range of rotation of cap lever 505.

Designated at 513 is a tool having a hole, into which pin 507 of cap lever 505 is positionable. The tool is used for mounting cap lever 505 on support 515 provided on pump 53. Designated at 516 is a retaining member for ensuring the mounted state. Designated at 517 is a force-acting section for acting to cap 51 a force tending to bring cap 51 into contact with the orifice-formed face. The force-acting section has inlet 517A, through which absorbed ink is introduced. Cap lever 505, pin 507, tool 513 and support 515 are formed with respective inner ink paths. When pump 53 provides absorbing force, ink is led through these paths as shown by arrow into pump 53.

Designated at 519 is a shaft projecting from the center of end face of pump 53. Pump 53 is rotatable about shaft 519. The rotational force is coupled to cap lever 505 via support 515, and as a result cap 51 is retreated. Joint 512 is coupled to member 523, on which tube 57 is mounted. Shaft 519, joint 521 and member 523 are formed with respective ink paths, and ink absorbed by pump 53 is led through these paths and tube 57 into waste ink tank 55 as shown by arrows in the Figure.

Designated at 525 is a piston of pump 53, at 527 is a shaft, at 529 is a packing, and at 533 is a pin mounted on piston shaft 527 and receiving transmitted force for operating piston shaft 527.

Designated at 535 is a blade lever with blade 59 mounted thereon. The blade lever is rotatably mounted on a shaft projecting from end face of pump 53, and as it is rotated, blade 59 is projected toward or retreated away from the recording head. Designated at 537 is a spring, which provides to blade lever 535 a rotational force in a direction to cause projection of blade 59. Designated at 539 is a spring providing pump 53 a tendency of rotation toward the recording head.

Designated at 541 is a gear train for transmitting the rotation of motor 61 to cam unit 63. Cam unit 63 includes cam 547 engaging with engagement member 545 provided on pump 53 for rotating the member, cam 549 engaging with pin 533 provided on piston shaft 527 of pump 53 for operating the pump, cam 553 engaging with engagement member 551 provided on blade lever 535 for rotating the member, and cam 557 engaging with switch 555 for detecting the home position of cam unit 63.

The operations of these cams will be described later.

Figure 9:
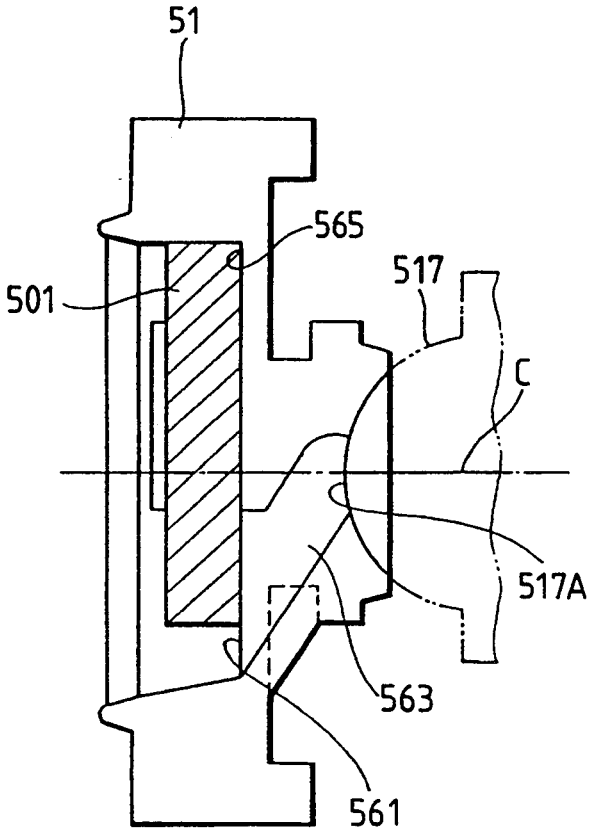
FIG. 9 is a side sectional view showing a cap section in the same mechanism.

FIG. 9 is a sectional view showing cap 51 and other components.

In this embodiment, ink absorbing port 561 in the cap is open in a downward direction, and ink path 563 is formed such that it leads to ink inlet 517A provided in operating portion 51 of cap lever 505. Absorbing port 561 is not completely covered by absorbing member 501.

With this construction, ink issued in a jetting recovering process or the like and flowing downwards due to the gravity is absorbed through a lower absorbing port 561, and therefore the amount of ink remaining in ink absorbing member 501 is extremely reduced. It is thus possible to greatly retard deterioration or the like of ink due to solidification thereof and hence extend the life of the ink absorbing member and cap 51 carrying the ink absorbing member.

Figure 10:
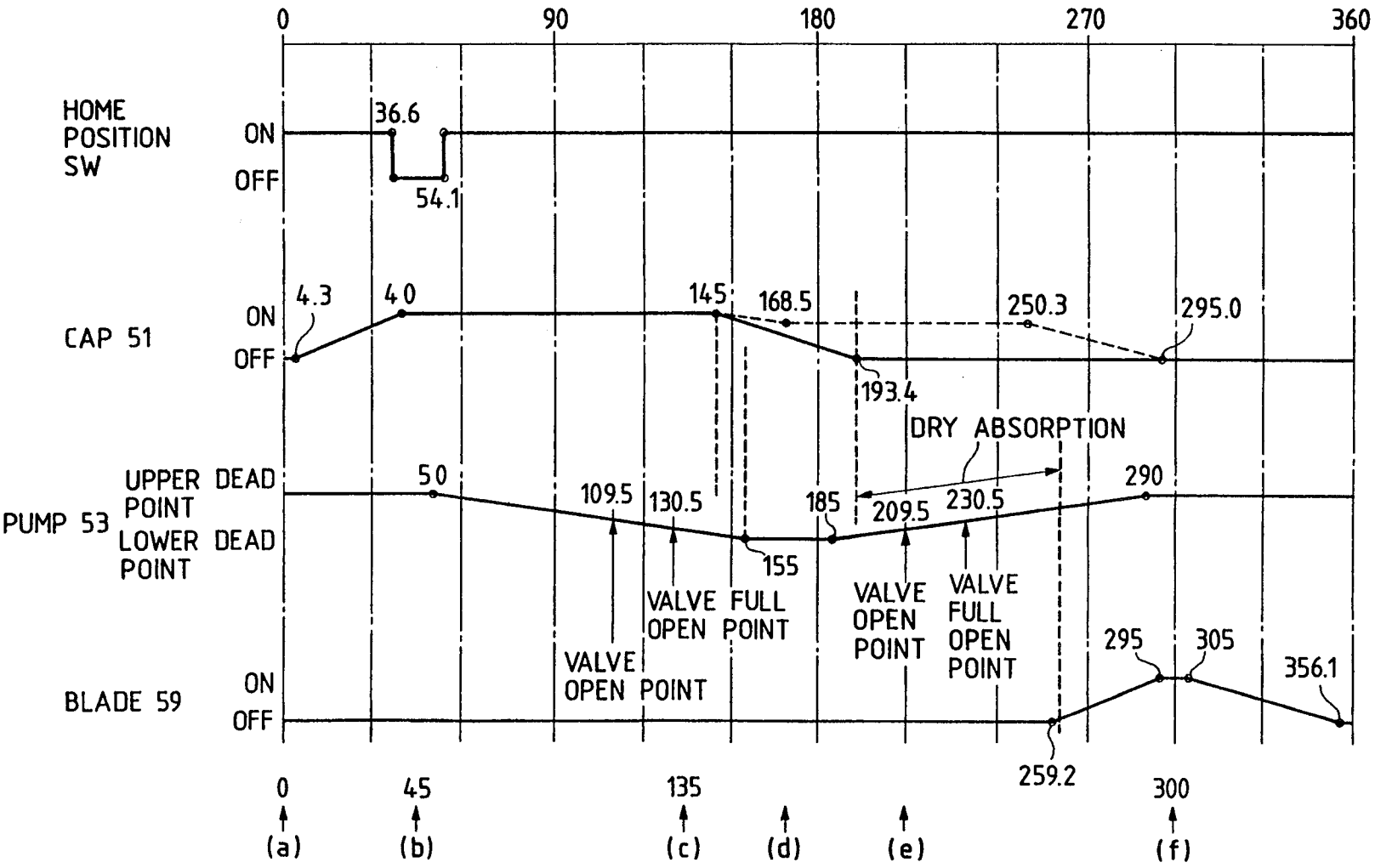
FIG. 10 is a timing chart showing a sequence of recovering operation in the same mechanism.
Figure 11:
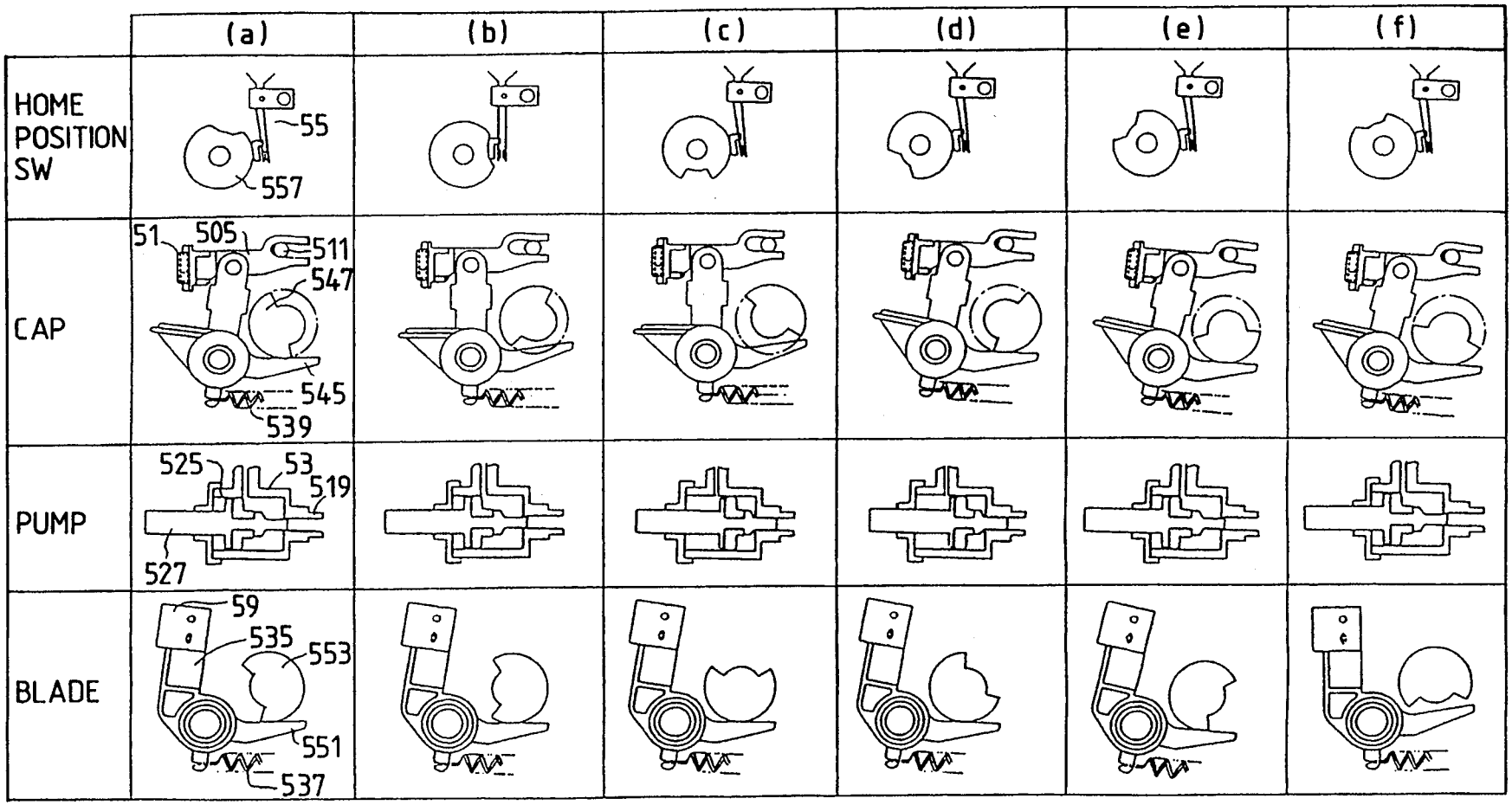
FIG. 11 is a sequential view illustrating operations of various parts in the discharging recovering operation of the above mechanism.

FIGS. 10 and 11 are respectively a view showing contour lines of individual cams of cam unit 63 and a view illustrating operating positions of various parts corresponding to respective cam positions. Numerical values in FIG. 10 represent rotational angles of the cams.

Referring to the Figures, shown at (a) are cam position and state of various parts when performing recording. In this instance, cap 51 and blade 59 are separated from the orifice-formed face of the recording head, and pump 53 is at its upper dead center. Shown at (b) is home position switch 55 at its "off" position. This position is referred to as home position of cam unit 63.

This position is set during waitng recording or the like. At this instance, cap 51 is covering the orifice-formed face, and blade 59 is retreated. Further, pump 53 is at its upper dead center.

When cam is rotated from position (b), piston 525 is moved toward the lower dead center with cap 51 held put on the orifice-formed face, and the negative pressure of the absorbing system leading to the cap is increased. Eventually, position 525 reaches the ink inlet of the pump, and after a period, during which the ink inlet is closed (i.e., an "off" period of a value), the value turns to be opened (point of 109.5 degrees) to be fully opened (point of 130.5 degrees). Subsequently, piston 525 reaches position (c) near the lower dead center. At this position, the cam is held stationary for a predetermined period of time to effect sufficient absorbing in consideration of the resistance offered to fluid in the ink absorbing system, and then the cam is rotated again. Piston 525 then reaches the lower dead center, and cap 51 turns to be separated from the orifice-formed face. This position (d) is held for a predetermined period of time.

When the cam is subsequently further rotated, piston 52 turns to proceed toward the upper dead center again. During this course, the value turns to be closed (point of 209.5 degrees) to be fully closed (point 230.5 degrees). Meanwhile, cap 51 at position (e) is separated from the orifice-formed face. In the neighborhood of this position, piston 525 is driven several times, whereby ink remaining in the ink absorbing system is absorbed toward the pump side (the absorption being referred to as idling absorption). Spaces on the opposite sides of piston 525 in the pump are communicated with each other by a flow path (not shown), which is closed when the piston is proceeding from the upper dead center to the lower dead center and is open when the piston is proceeding from the lower dead center to the upper dead center. Further, the space on the right side of the piston is communicating with a flow path provided in pump shaft 519. Thus, when piston 525 is proceeding from the lower dead center to the upper dead center during idling absorption, ink introduced into the space on the left side of the piston is transferred to the right side space. When the piston is proceeding from the upper dead center to the lower dead center, on the other hand, introduction of ink from the ink absorbing system into the left side space and discharging of ink from the right side space into the waste ink tank are effected.

When the cam is subsequently further rotated forwardly, blade 59 is projected to be ready for wiping (position (f)). When carriage 11 is moved toward a recording area in this state, blade 59 engages with the orifice-formed face of the head and wipes ink away from the face. Afterwards, the cam is further rotated to cause retreat of blade 55, and it is set at position (a). In this state, carriage 11 is moved toward the cap so that the orifice-formed face of the head faces cap 51. Then, the cam is moved to position (b) to put on the cap and is stopped.

When bringing about recording from the waiting state, the recording may be started after effecting wiping by projecting blade 59 with rotation of the cam caused in the positive or negative direction from position (b).

Now, a control system for controlling various parts of the document processing system having the above construction, will be described with reference to FIG. 12.

Referring to the Figure, designated at 10 is a control unit, which can process characters or the like input from keyboard unit 1 and display processed data on display 6 and operate printer unit 8 according to recording instructions from keyboard unit 1. Control unit 10 includes MPU 1000 for executing various control routines, ROM 1001 for storing the control routines and data, RAM 1002 used as work area or the like in the execution of control, CG 1003 for storing patterns of characters or the like input from keyboard unit 1, and interface unit 1004 for effecting connection to keyboard unit 1 and like external units. Control unit 10 and printer unit 8 are electrically connected to each other via signal line 1005.

Printer unit 8 includes printer control unit 80 for controlling head 9 and so forth to alleviate the load on control unit 10. Printer control unit 80 has substantially the same construction as control unit 10 and includes MPU 800, ROM 801, RAM 802, timer 803 for measuring time and interface unit 804.

In printer unit 8, head 9, carriage motor 31, feed motor 35 and recovering system motor 61 are controlled by printer control unit 80, and they are driven by head driver 9A, and motor drivers 31A, 35A and 61A. These motors 31, 35 and 61 have DC motor construction, and their rotational direction is controlled according to the polarity of drive pulse. Further, printer control unit 80 can recognize capping position and moving position of carriage 11. Further, the control unit can recognize setting of recording medium in feed tray 4 on the basis of detection of paper sensor 69 of transmitting or reflecting type consisting of light-emitting and light-receiving elements.

In the above construction, when a document producing process is started and a print start command is provided with depression of a print key (not shown) on keyboard unit 1, MPU 1000 of control unit 10 converts an input document consisting of characters and the like into print data with reference to CG 1003. MPU 1000 adds control commands to print data thus obtained by conversion and transfers the resultant data through interface control unit 1004 and signal line 1005 to printer control unit 80. MPU 800 of printer control unit 80 receiving transferred data controls head 9 and so forth to effect printing while interpreting the control commands added to print data with reference to a command table stored in ROM 801.

Figure 13:
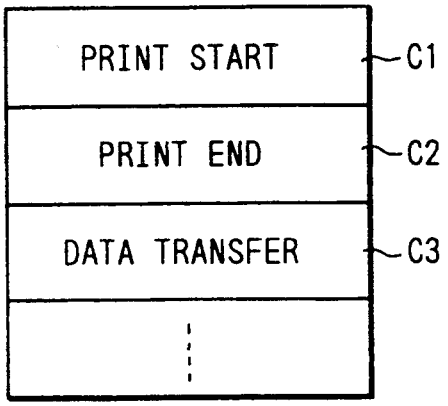
FIG. 13 is a command table showing commands used in the same control system.

FIG. 13 shows the control command table noted above stored in ROM 80 of printer control unit 80. Referring to the Figure, designated at C1 is a print start command instructing the start of printing, and at C2 a print end command instructing the end of printing. The print end command instructs the end of printing of the last page in case of data covering a plurality of pages. Designated at C3 is a data transfer command instructing transfer of print data in number corresponding to the number instructed by data which is transferred next.

Figure 14:
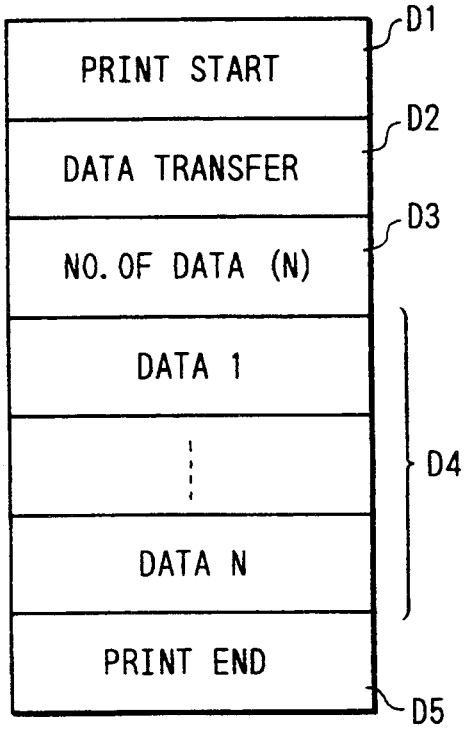
FIG. 14 is a format of data transferred in the above control system.

FIG. 14 is a view showing a format of data transferred from control unit 10 and printer control unit 80. In case of a document covering a plurality of pages, print start command D1 is transfered at first, and then data transfer command D2, transferred data number (N) D3, N data pieces D4 and line feed command D5 are transferred in the mentioned order. Up to this point, one line is printed.

Now, a control routine for carriage position recognition executed by printer control unit 80 receiving data transferred from control unit 10 as noted above will be described with reference to flow charts of FIGS. 15 to 18 and a timing chart of FIG. 19.

Figure 15:
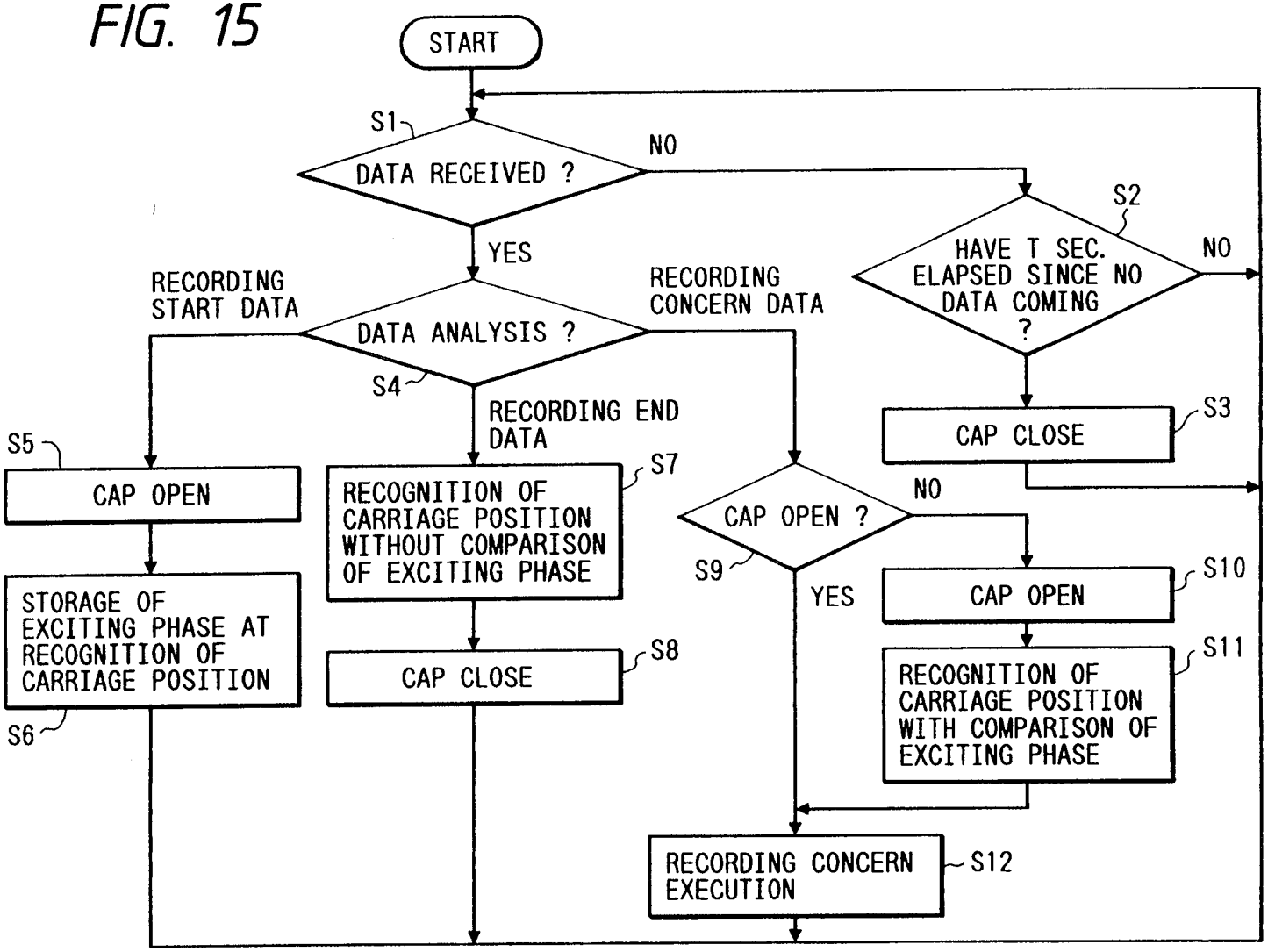
FIGS. 15 to 18 are flow charts illustrating a control routine executed in the above control system.

Control routine shown in FIG. 15 is started when a predetermined initializing operation is ended after closure of printer unit 8.

In first step S1, MPU 800 receives data from control unit 10 as host unit and executes a check as to whether there is no received data. If there is received data, MPU 800 executes a check in step S2 as to whether T seconds has passed since there is no data. If the time has passed, the routine goes to step S1. If the time has passed, cap 5 is closed in step S3, and the routine goes back to step S1.

The operation of closing cap 51 is performed by driving recovering system motor 61 such that cam unit 63 is moved from recording operation position (a) to home position (b) in FIGS. 10 and 11.

If it is found in step S1 that there is data, MPU 800 executes data analysis. If the data analyzed is recording start data, the routine goes to step S5. If the data is recording end data, the routine goes to step S7. If the data is recording concern data (such as those concerning movement of carriage or paper feed), the routine goes to step S9.

In step S5, cap 51 is opened, and in subsequent step S6 recognition of position of carriage 11 storing exciting phase as reference position data as will be described later is done. The routine then goes back to step S1.

In step S7, carriage position recognition is executed without use of exciting phase as reference position data as will be described later, and in subsequent step S8 cap 51 is closed. The routine then goes back to step S1. Thus, even if running of carriage 11 is disturbed during recording so that the stored reference exciting phase is no longer meaningless, the capping of the recording head is not adversely affected at all.

In step S9, a check is done as to whether cap 51 is open. If the cap is open, the routine goes to step S12. If the cap is closed, it is opened in step S10. In subsequent step S11 recognition of position of carriage 11 is executed by using the exciting phase as reference position data to be described later, and then in step S12 recording concern data content is executed. The routine then goes back to step S1. Thus, there is no possibility of deviation of recording positions of upper and lower lines.

Figure 16:
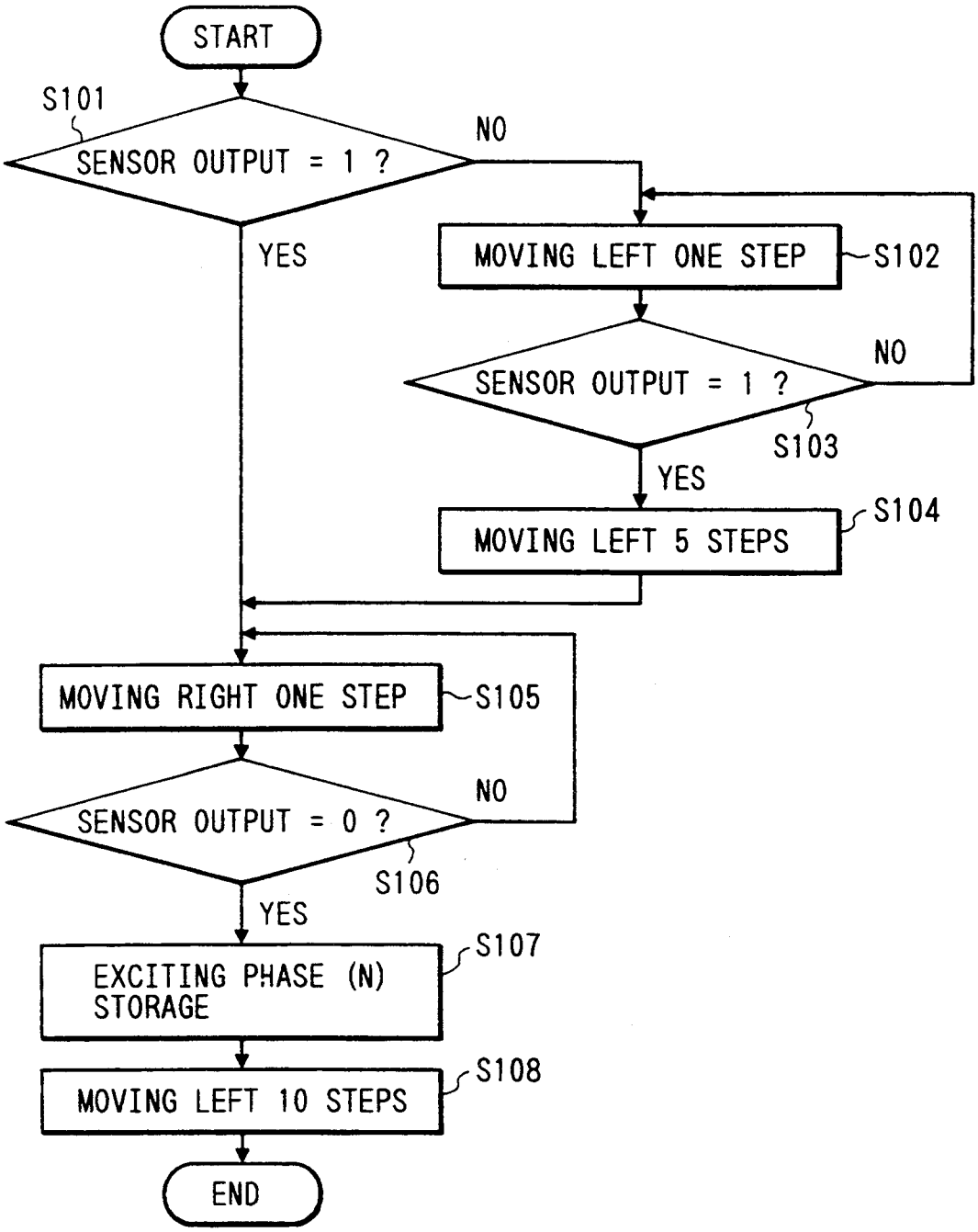

FIG. 16 shows details of step S6 shown in FIG. 15. This flow chart illustrates a routine of storing the exciting phase at the time of carriage position recognition.

In first step S101, MPU 800 detects a sensor output from carriage sensor 67 and executes a check as to whether carriage 11 is on the left or right side of the sensor position. The sensor output from carriage sensor 67, as shown in FIG. 19, undergoes a level change at sensor detection position, which is on the right side of cap position by 10 steps. If the sensor output is not "1", the carriage is on the right side of the sensor detection position. Therefore, in this case step S102 is executed, in which the carriage is moved one step to the left, and then in step S103 the sensor output is detected. Steps S102 and S103 are executed repeatedly until the sensor output is "1". If it is found in step S103 that the sensor output is "1", the carriage is moved 5 steps to the left in step S104.

The operation of steps S102 through S104 is performed because if the detection is not done in the same direction, positional deviation is liable between the instant of detection in rightward movement and that in leftward movement due to backlash of the carriage drive system or like causes. In this embodiment, detection is effected when carriage 11 is moved to the right. This means that when carriage 11 is on the left side of carriage sensor 67, it is moved to the right side of the sensor. The five steps in step S104 may be such that backlash or the like vanishes when the direction of movement of carriage 11 is changed.

Figure 20:
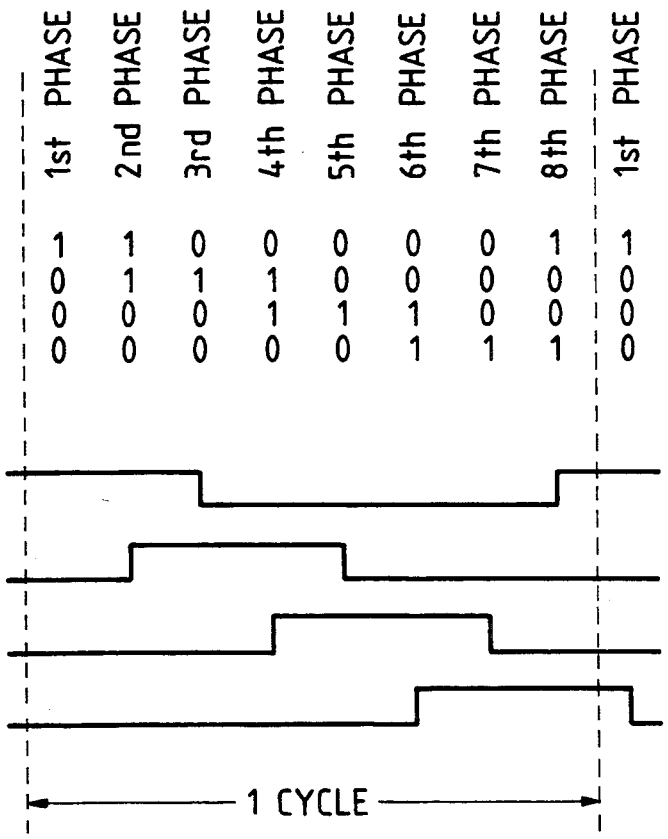
FIG. 20 is a view showing exciting phases used in the system.

The routine subsequently goes to step S105. Since the sensor output is "1" at this time, it is detected that carriage 11 is on the left side of the sensor detection position. Therefore, in step S105 carriage 11 is moved one step to the right, and in subsequent step S106 the sensor output is detected. Steps S105 and S106 are repeatedly executed until the sensor output is inverted to "0". If it is found in step S106 that the sensor output is "0", the routine goes to step S107, in which the prevailing exciting phase (i.e., N-th phase) is stored in RAM 802 in FIG. 1. Here N takes one of values 1 to 8 when the stepping motor is driven in I II phase as shown in FIG. 20.

Figure 19:
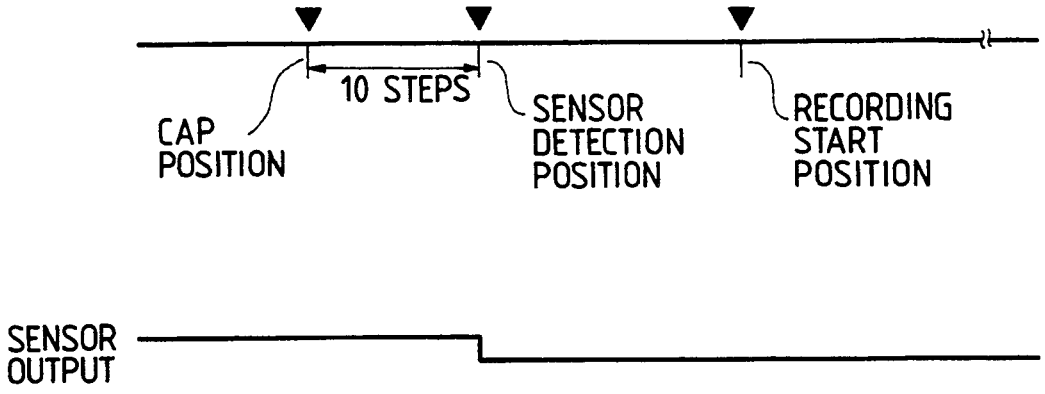
FIG. 19 is a timing chart illustrating an operation in the system.

The routine then goes to step S108, in which carriage 11 is moved 10 steps to the left to the position of cap 51 as shown in FIG. 19. Step S108 is not particularly necessary during operation at the start of recording.

Figure 12:
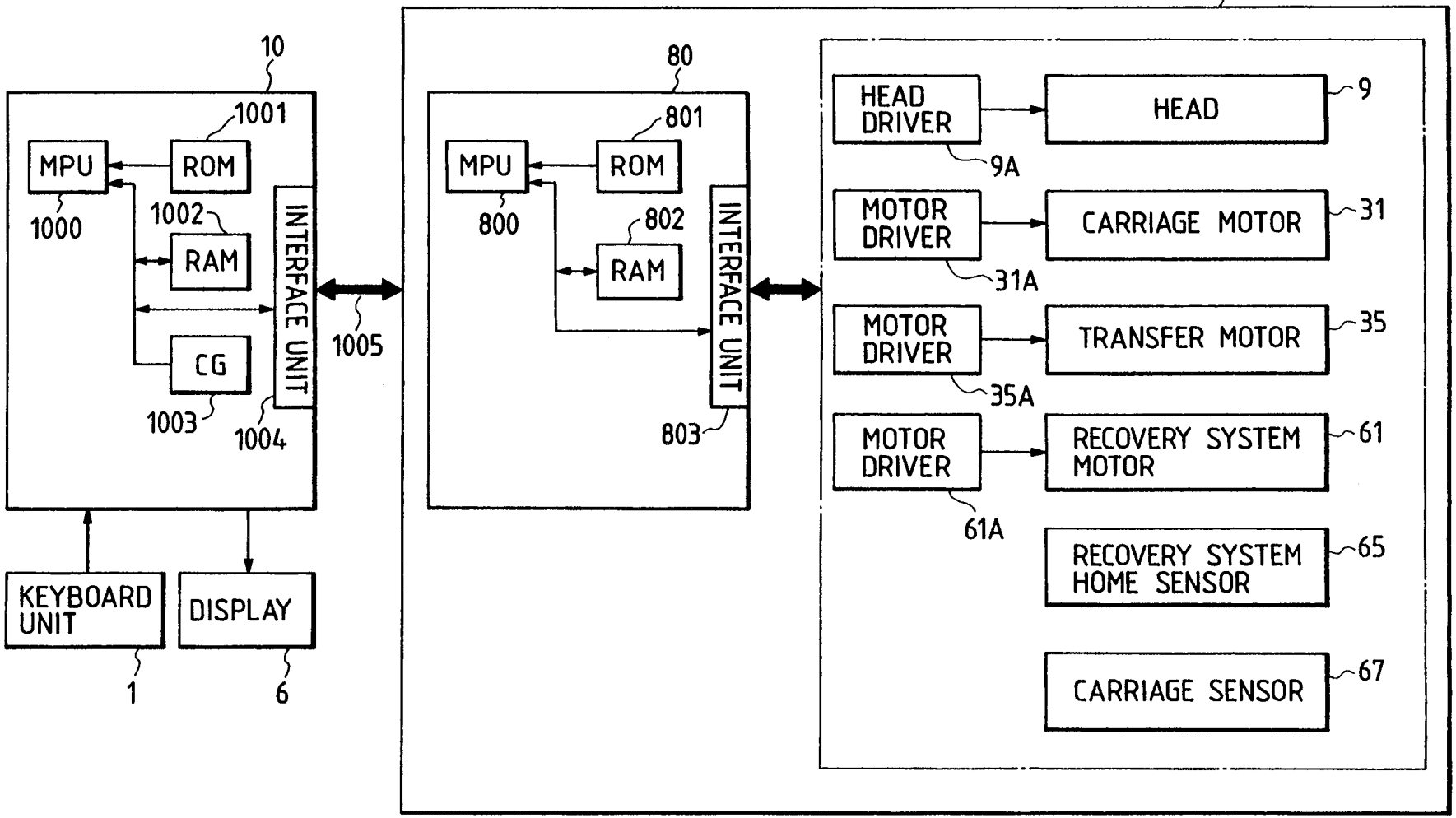
FIG. 12 is a block diagram showing a control system as first embodiment of the invention applied to the recording apparatus shown in FIG. 2 and so forth.
Figure 17:
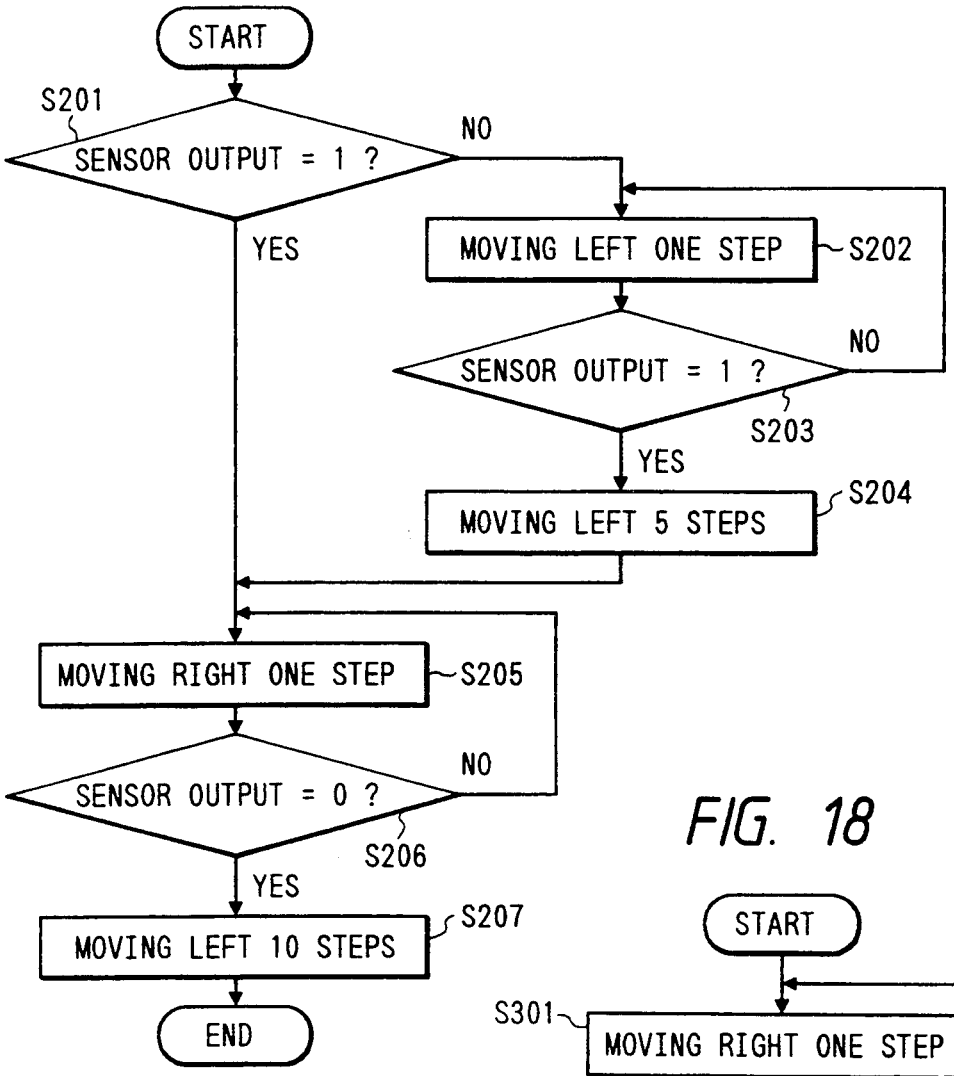

FIG. 17 illustrates details of step S7 shown in FIG. 12. This flow chart shows a routine, in which no exciting phase is stored at the time of carriage position recognition.

Steps S201 to S206 in FIG. 17 are like steps S101 to S106 in FIG. 16, and therefore their description is not given. If it is found in step S206 in FIG. 17 that the sensor output is "0", the routine goes to step S207 without storing exciting phase. In step S207, carriage 11 is moved 10 steps to the left to bring it to the position of cap 51, as shown in FIG. 19.

Figure 18:
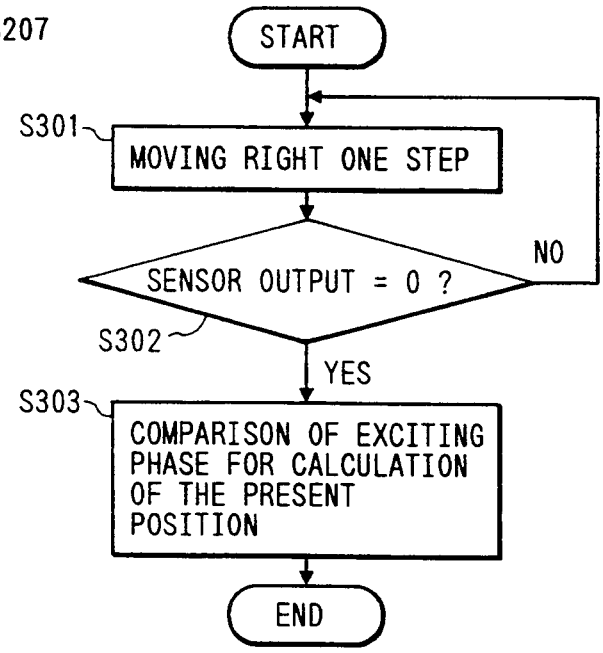

FIG. 18 shows details of step S11 in FIG. 15. This flow chart illustrates a routine executed when carriage 11 is moved for recording or like purpose after opening the cap. The routine is executed to effect recognition of position of carriage 11 using stored exciting phase.

Since the cap has been opposed, carriage 11 is at the cap position shown in FIG. 19. Thus, in step S301 carriage 11 is moved one step to the right, and in step S302 the sensor output is detected. Steps S301 and S302 are executed until the sensor output becomes "0". If it is found in step S302 that the sensor output is "0", the routine goes to step S303. In step S303, the prevailing exciting phase (which is assumed to be n-th phase) and the exciting phase (N-th phase) stored in step S107 in FIG. 16 are compared. Then, corrected value K is obtained from corrected value conversion table correlating N-th and n-th phases as shown in FIG. 21 such that no correction is done if the N-th and n-th phases are the same while correction by one step is done if the N-th and n-th phases are adjacent phases, thus recognizing that the prevent position of carriage 11 is (10+K) steps to the right from the cap position.

As shown above, in this embodiment recognition of position of carriage 11 is done on the basis of the exciting phase as reference position data stored during recording (step S11), and therefore there is no possibility of deviation of recording between upper and lower lines. Further, it is possible to cope with a case, in which the running of carriage 11 is disturbed due to an external cause (such as jamming of paper) produced during recording, thus resulting in a tooth jump of gear in the motor drive system and making the exciting phase stored as reference position data meaningless. Even in this case, regarding capping at the end of recording or at the time of absorbing recovering position recognition is effected without use of any reference exciting phase when a detection signal is provided (step S7). Therefore, the capping of the recording head is never adversely affected.

It is thus possible to eliminate defective jetting due to defective capping or inability of absorbing ink through the cap at the time of absorbing recovering and maintain the performance of the recording head for long time.

It is further possible to cope with a case, when the reference exciting phase is made meaningless by tooth jump of a gear or the like resulting from an external cause as noted above. Even in this case, since the exciting phase of the stepping motor is stored afresh as reference position data when a detection signal is provided at the start of recording, the exciting phase as reference position data is effective after the start of the next page or next recording.

While in this embodiment the exciting phase as reference position data is stored afresh at the start of recording, it is possible to effect position recognition without use of the reference exciting phase stored when a detection signal is provided when effecting capping at the time of closure of power source, at the end of recording and at the time of absorbing recovering, while storing the stepping motor exciting phase afresh as reference position data at the time of appearance of the detection signal.

Further, when effecting capping of the recording head during recording (step S3), the carriage position recognition may be done without use of any reference exciting phase at the time of appearance of a detection signal. Doing so eliminates positional deviation between the head and cap 51. In this case, however, carriage position recognition control (for instance step S7) is executed, thus requiring corresponding additional time.

In the above embodiment, control unit 10 transferred recording data to printer control unit 80 of printer unit 8, while printer control unit 80 controlled head 9 and so forth for recording. However, it is also possible to let control unit 10 control printer unit 8 directly.

As has been shown above, this embodiment permits prevention of recording deviation during recording and also permits carriage position recognition to be done without adversely affecting the capping during a non-recording period.

Now, a second embodiment of the invention will be described in detail with reference to the drawings.

Figure 22:
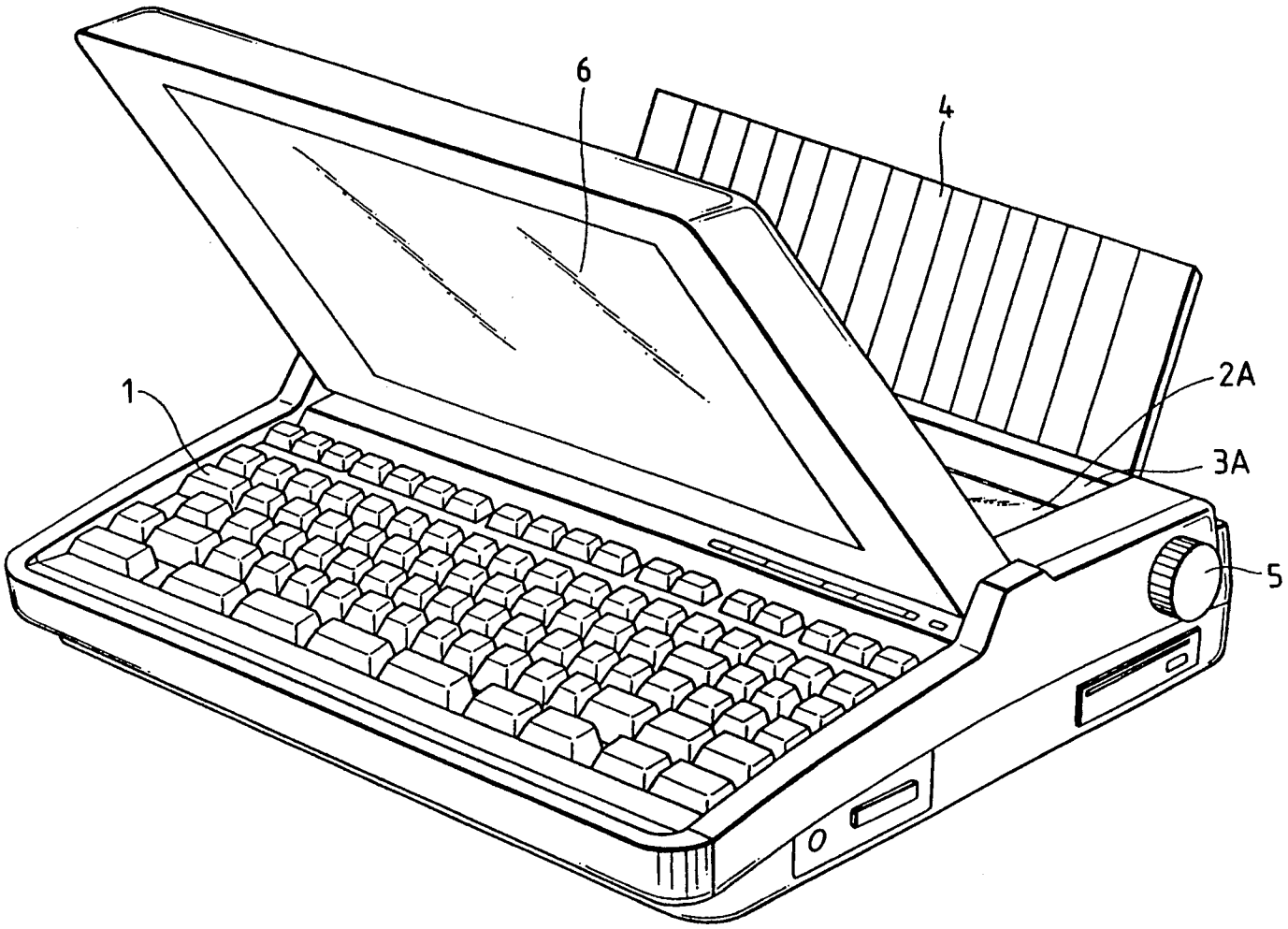
FIG. 22 is a perspective view showing a second embodiment of the invention applied to a document processing system.

FIG. 22 is a perspective view showing a document producing apparatus (hereinafter referred to as word processor) to which a second embodiment of the invention can be applied.

Referring to the Figure, designated at 1 is a keyboard unit as input unit. Designated at 6 is a display unit for displaying input document or the like. The display unit is rotatably supported, and when the apparatus is not used, the unit can be folded against keyboard unit 1 so that the apparatus can be carried along.

Designated at 2A is a protective cover, which is provided at a visual confirmation opening for visually confirming the operating state of the recording head. Designated at 34 is a roller cover supporting a roller.

Designated at 4 is a paper tray paper supporter for supporting paper when feeding recording paper, and at 5 is a knob for manually feeding paper.

Figure 23:
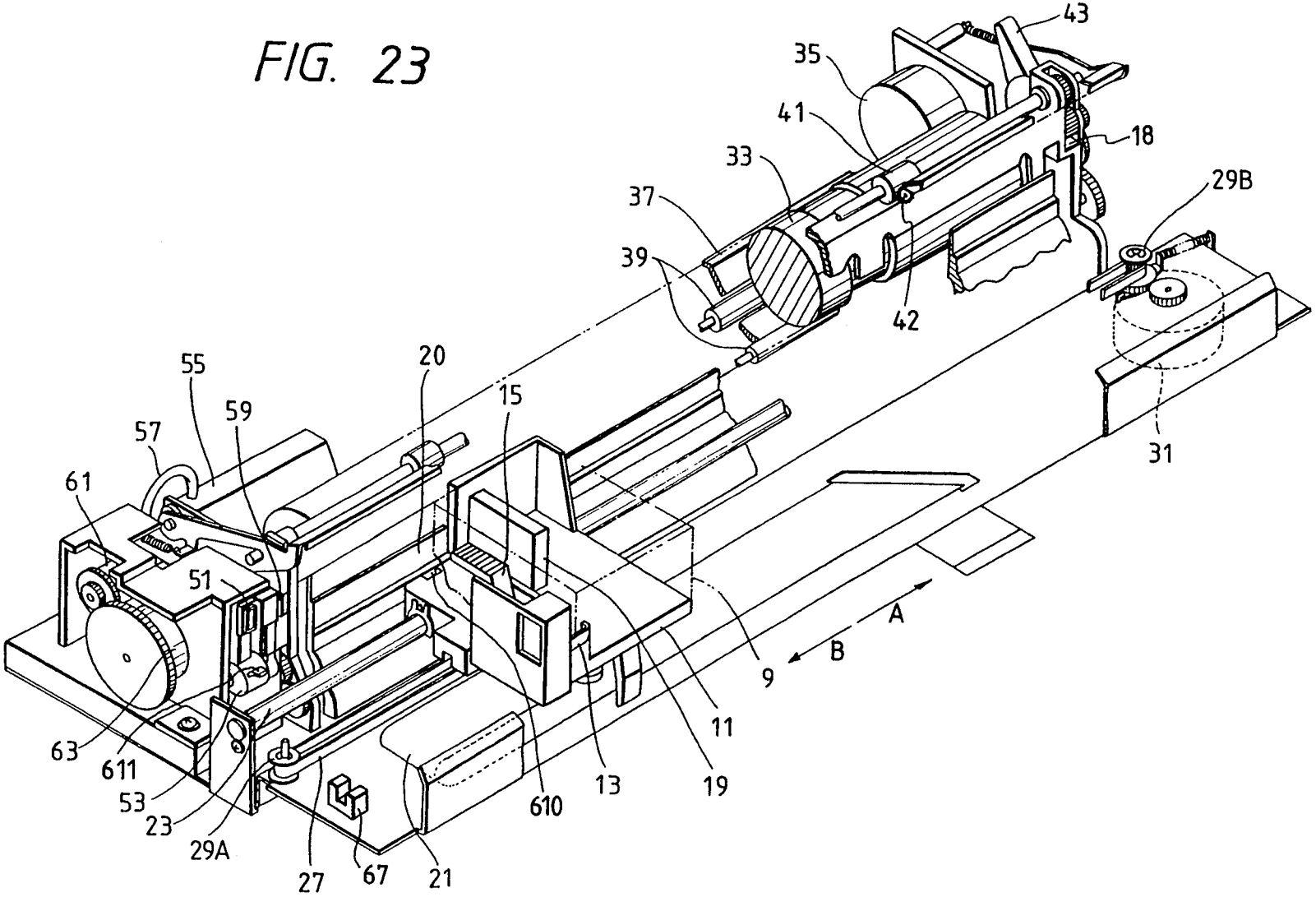
FIG. 23 is a perspective view showing an example of printer which can be used in the second embodiment of the invention.

FIG. 23 shows an example of the printer unit in this embodiment of the ink jet recording apparatus. The illustrated construction is basically the same as the construction of the printer unit in the first embodiment, and parts like those in function in FIG. 2 are designated by like reference numerals, and their description is not given.

Referring to the Figure, designated at 9 is a head cartridge internally having ink, ink discharging orifices and electric connection section. Designated at 11 is a carriage for scanning in directions of arrows A and B together with the carrying head cartridge. Designated at 13 is a hook for mounting head cartridge 9 on carriage 11, and at 15 is a lever for operating hook 13.

Designated at 60 is a recessed portion, into which projecting portion 611 (to be described later) is inserted.

Designated at 18 is a platen provided adjacent head cartridge 9 at a position thereof facing the ink discharging orifices. The platen has an elastic member (not shown) which urges recording medium against paper pan front portion 20.

This embodiment adopts as recording head an ink jet recording head for performing recording through ink jetting. Thus, the distance between the ink discharging orifices of the head and recording surface of the recording medium should be comparatively small. In addition, the distance should be controlled stringently in order to avoid contact between the recording medium and discharging orifices. To this end, it is effective to regulate the position of the recording medium with paper pan front portion 20. Designated at 43 is a release lever for releasing the bias of feed roller 39, roller 42 and platen 18 when mounting and dismounting the recording medium. Designated at 67 is a sensor for detecting the position of carriage 11. The sensor detects the position of carriage 11 when a projection (not shown) thereof passes by it.

Designated at 53 is a pump, which can provide an absorbing force for forced discharge of ink and also be used for absorbing ink received in cap 51 in jetting recovering process through preliminary jetting. The outer side of pump 53 is formed with projecting portion 611 which is inserted into recessed portion 610 of carriage 11.

Figure 24:
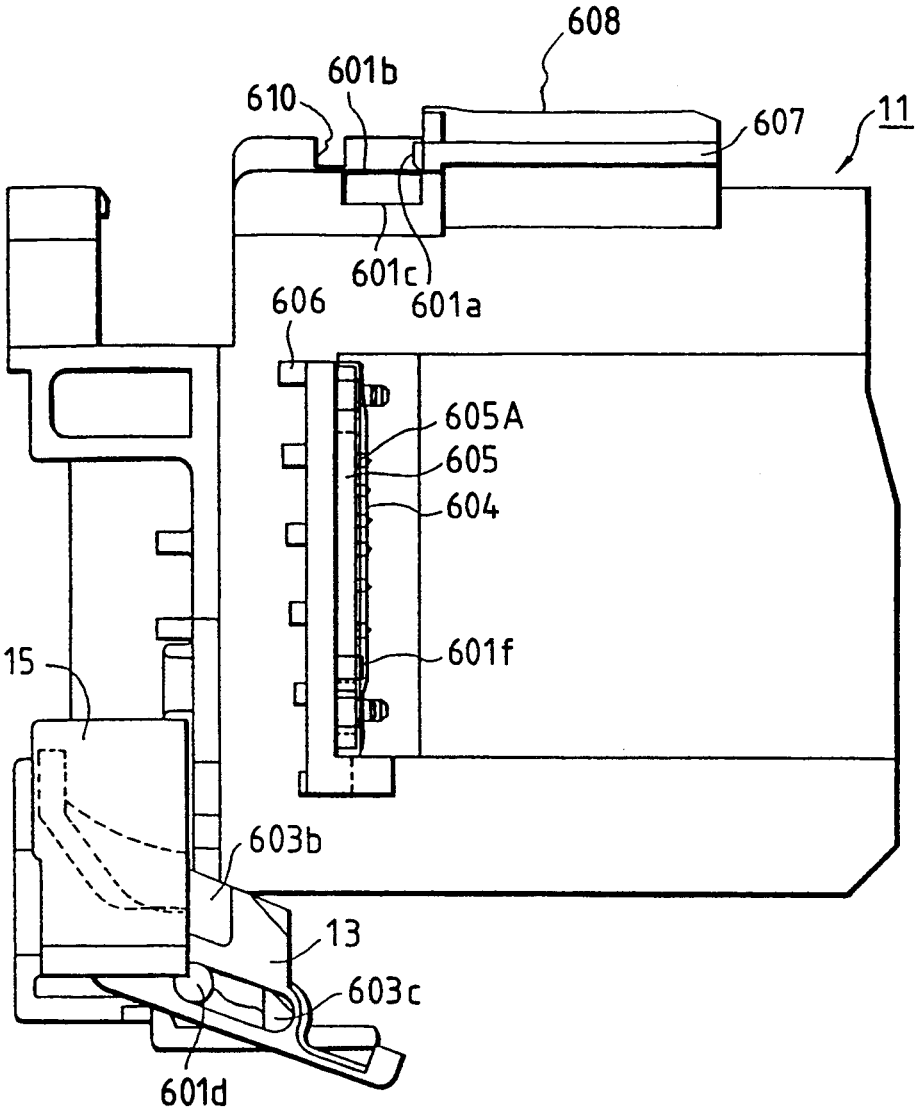
FIG. 24 is a top view schematically showing a carriage for carrying a head cartridge.

FIG. 24 is a top view showing carriage 11 in detail.

Referring to the Figure, designated at 606 is a support plate erected from the bottom of carriage 11. The support plate supports flexible board 604 and rubber pad 605 having projection 605A opposing a terminal pad formed on board 604.

Designated at 607 is a striker similarly erected from the bottom of carriage 11 in a front portion thereof. Striker 607 has a small thickness to provide for as large ink tank space as possible in space zone defined by head cartridge 9 and carriage 11. To this end, striker 607 is formed with three ribs 608 for ensuring mechanical strength. Ribs 608 extend in a direction of movement of carriage 11 to provide mechanical strength corresponding to movement of the head cartridge in the revolving direction at the time of mounting and dismounting. Ribs 608 are formed such that they project forwardly by about 0.1 mm from the orifice-formed face of head cartridge 9 when the cartridge is mounted. With this arrangement, the orifice-formed face can be prevented from being rubbed and damaged by recording paper when the recording paper occasionally gets into the path of movement of the recording head.

Operating lever 15 for mounting and dismounting the head cartridge, is rotatably supported by shaft 601*d* provided on the body of carriage 11. Hook 13 is used for mounting and dismounting head cartridge 9 in engagement with its portion with movement in a state of engagement with a portion of operating lever 15. The hook 13 effects the operation noted above concerning the mounting and dismounting with slot 603*c* formed in it guided by guide shaft 601*c* provided on the body of carriage 11.

As has been described above in connection with the first embodiment, the mechanism for the mounting/dismounting operation consisting of operating lever 15 and hook 13 is provided on the side of carriage 11, i.e., on the side, toward which carriage 11 is moved, and therefore the mechanism will never require a great dead space when the carriage is moved.

Designated at 610 is a recessed engagement portion provided in the carriage and capable of engaging with projecting engagement member 611 formed on a member constituting cap means to be described later. Recessed engagement portion is formed in a front face area of carriage corresponding to a portion of the head cartridge mounted on the carriage, on which portion the recording head is located.

This portion permits the state of engagement between the orifice-formed face of the head and cap to be stably maintained when it is engaged with projecting engagement portion 611 on the cap means side.

With the engagement between recessed engagement portion 610 and projecting engagement portion 611 of the cap means, the carriage carrying the recording head in a capped state is held in position without possibility of occasional movement.

The main part of the recovering unit in the first embodiment consisting of cap 51, pump 53, blade 59, motor 61 and cam unit 63 shown in FIG. 8 is basically like that in the second embodiment. In the second embodiment, however, the outer periphery of pump 53 on the side of mounting cap member 51 is provided with projecting engagement portion 611 capable of engagement with recessed engagement portion 610 of carriage 11. In a cam operation to be described later, projecting engagement portion 611 is advanced with advancement of cap 51 and engages with recessed engagement portion 610 when cap 51 is in engagement of the orifice-formed face of the recording head, thus preventing occasional movement of the carriage. Particularly, in this embodiment projecting engagement portion 611 is formed in a positional relation such that its central portion is found on vertical center line of cap 51. With this arrangement, satisfactory hold state can be obtained, which is never affected with slight external force exerted when the cap is in contact with the recording head.

The operation of various parts of cam unit 63 in this embodiment is basically the same as in the first embodiment as described before in connection with FIGS. 10 and 11.

Now, control operation of various parts of the second embodiment having the above construction will be described. The control structure and basic control routine of this embodiment are the same as those in the first embodiment as described before in connection with FIGS. 12 to 21, and only featuring part of this embodiment will be described in detail.

Figure 25:
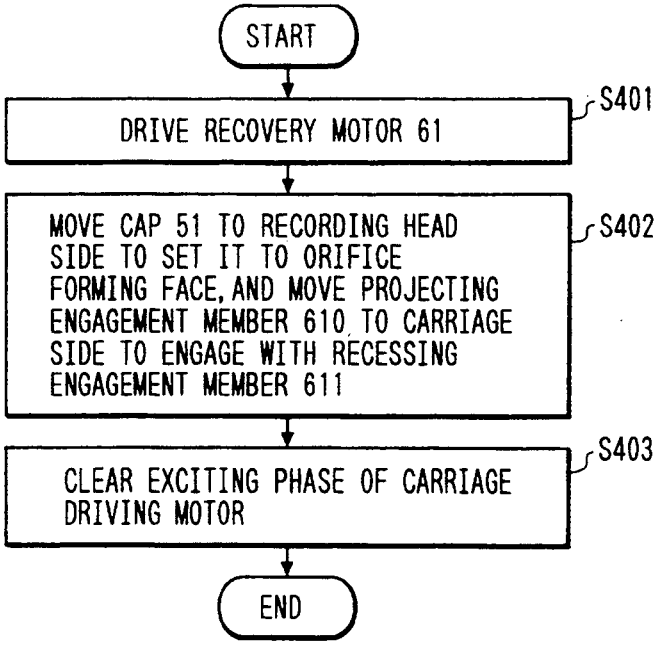
FIG. 25 is a flow chart showing a control routine executed in the second embodiment.

This embodiment has a feature in a operation when closing cap 51, i.e., operation in steps S3 and S8 in FIG. 15. FIG. 25 shows the operation when closing the cap in detail. Step S8 will now be described.

In the explanation of step S7 shown in FIG. 17, it is assumed that carriage motor 31 has been driven in step S207 to move carriage 11, 10 steps to the left (i.e., to the non-recording area side) so that motor 31 for driving carriage 11 with a predetermined exciting phase is held.

In this state, step S410 in FIG. 25 is executed to drive recovering system motor 61 so as to move cap means to the side of the recording head.

Then, in step S402 cap 51 is moved to the side of the orifice-formed face of recording head 9*a* (i.e., from state (a) to state (b) shown in FIG. 7), thus bringing the cap and head into contact with each other and closing the cap. Simultaneously with the movement of cap 51 projecting engagement portion 610 provided on the cap means side is moved toward the carriage and downwardly toward carriage side recessed engagement portion 611, and these two portions are engaged with each other. After projecting engagement portion 610 of cap means side and recessed engagement portion 611 of the carriage are engaged with each other in step S402, step S403 is executed to stop carriage drive motor 31 (state of 0 power consumption) to clear the exciting phase thereof.

In this way, carriage 11 can be reliably held in an area opposing the cap means, thus attaining reliable capped state of the orifice-formed face.

In addition, since the exciting phase of carriage drive motor 31 is cleared, reduction of power consumption can be obtained, and also damage to carriage drive motor 31 can be extremely reduced.

Particularly, where the apparatus is portable, the capped state of the orifice-formed face of the recording head can be reliably maintained even when the apparatus is carried, and the reliability of capping is improved.

Further, the jetting recovering of the recording head subsequent to the capping can be reliably done.

In the meantime, projecting engagement portion 611 is arranged such that it can not be readily moved unless motor drive force is applied through cap means side gear structure, and therefore the state of engagement can be reliably maintained.

To ensure more reliable state of engagement, it is possible to alter the gear structure of the cap means or, as an alternate structure, a locking member may be provided, for maintaining the state of engagement of projecting engagement portion 611.

As has been shown above, in this embodiment the capping position can be determined reliably by scanning the carriage carrying the recording head with stepping motor and engaging the engagement portions of the cap drive means and carriage with each other in a non-recording area.

In addition, since the output of the stepping motor exciting phase is stopped in the engaged state, the possibility of movement of carriage in carriage-free state can be eliminated. Further, load on the stepping motor is eliminated to eliminate possible rupture of the motor and also permit reduction of power consumption.

Now, a third embodiment of the invention will be described. In this embodiment, the appearance and printer unit construction are the same as in those of the second embodiment described before in connection with FIGS. 22 and 23, and their description is not given. In addition, the operation of various parts of cam unit 63 in this embodiment is like that in the second embodiment. In this instance, the operation will be described again, however, in conjunction with the engagement relation of recessed and projecting portions 610 and 611 to each other.

Referring to FIG. 11, which illustrates contour lines of cams operations of various parts corresponding various cam positions in cam unit 63 in this embodiment as well as the previous first and second embodiments, shown in (a) are cam position and state of various parts when performing recording. In this instance, cap 51 and blade 59 are separated from the orifice-formed face of the recording head, and pump 53 is at the upper dead center. Further, projecting portion 611 is separated from recessed portion 610 of carriage 11.

Shown in (b) is an instance when home position switch 55 is "off". This position is made a home position of cam unit 63. This position is set at the time of waiting recording. At this instance, cap 51 is covering the orifice-formed face, blade 59 is retreated, and pump 53 is at the upper dead center. Further, projecting portion 611 is engaged with recessed portion 610 of carriage 11 and restricts movement of the carriage 11.

When the cam is rotated from position (b), cap 51 is brought into engagement with the orifice-formed face (to obtain a cap-"on" state), and with projecting and recessed portions 611 and 610 in engagement with each other piston 525 is moved toward the lower dead center, thus progressively increasing the negative pressure in the absorbing system leading to cap 51. Eventually, piston 523 reaches an ink inlet of pump 53, and then it reaches position (c) near the lower dead center.

When the cam is subsequently rotated again, piston 525 at the lower dead center, and cap 51 turns to be separated from the orifice-formed face, and projecting portion 611 from recessed portion 610, respectively. The resultant position (d) is held for a predetermined period of time.

When the cam is subsequently rotated further, piston 525 turns to proceed toward the upper dead center again. During this time, valve turns to be closed and eventually reaches a fully closed position. Meanwhile, cap 51, at position (e), is completely separated from the orifice-formed face.

When the cam is subsequently rotated further in forward direction, blade 59 is projected to a position capable of wiping (position (f)). When carriage 11 is moved to the side of the recording area in this state, blade 59 is engaged with the orifice-formed face of the head and wipes ink or the like away from the face. Then, the cam is further rotated to cause retreat of blade 59, and it is set at position (a). In this state, carriage 11 is moved to the cap side such that the orifice-formed face of the head faces cap 51. Thereafter, the cam is moved to position (b) for cap-"on" while projecting and recessed portions 611 and 610 are engaged with each other before it is stopped.

Figure 26:
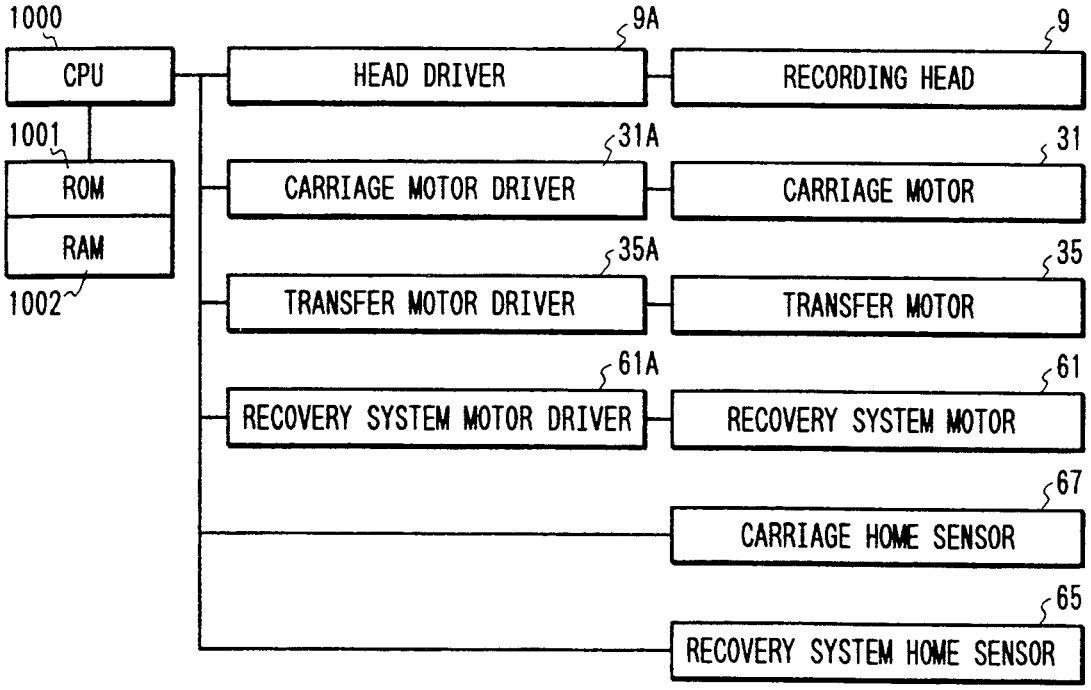
FIG. 26 is a block diagram showing a control system as third embodiment of the invention.

A control system for controlling various parts of this will now be described with reference to FIG. 26. In the Figure, parts having like functions as those of the control system of the first embodiment shown in FIG. 2 are designated by like reference numerals. Referring to FIG. 26, 1000 is a CPU for executing various control routines, at 1001 is a ROM for storing the control routines noted above and other data, and at 1002 is a RAM used for working area or the like in the execution of the control.

Of the above system, head cartridge (i.e., recording head) 9, carriage motor 31, feed motor 35 and recovering system motor 61 are controlled by CPU 1000. They are driven by head driver 9A and motor drivers 31A, 35A and 61A, respectively. Further, CPU 1000 can recognize cap position and position of carriage 11 on the basis of detection by recovering system home sensor 65 and carriage home sensor 67.

Now, a control routine of jetting recovering process under control of CPU 1000 will be described with reference to the flow charts of FIGS. 27 and 28.

Figure 27:
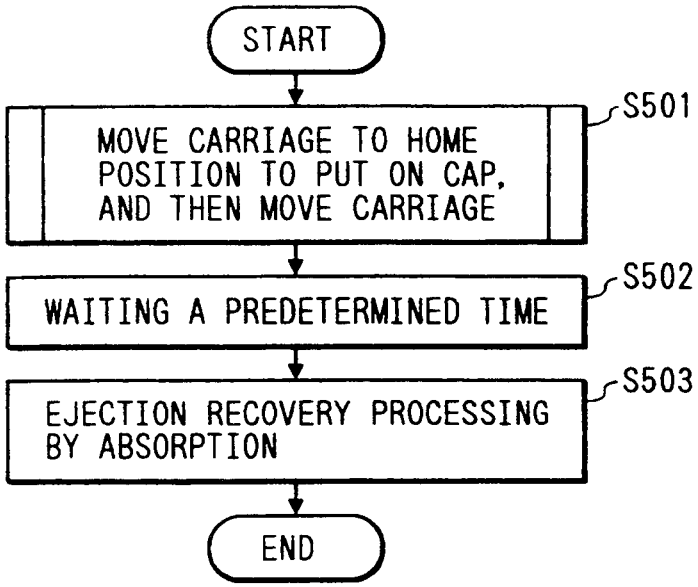
FIGS. 27 and 28 are flow charts showing a control routine in the same control system.

Referring to the FIG. 27, firstly in step S501 carriage 11 is moved to the home position to bring cap 51 into engagement with recording head 9, and then carriage 11 is rocked. By so doing, cap 51 can reliably cover the orifice-formed face of recording head 9. The method of this capping will be described hereinafter in detail.

Subsequently, the routine goes to step S502 to wait for a predetermined period of time. The waiting is done for cap 51 made of an elastic material such as rubber is tentatively deformed by a load which is produced as a result of movement of carriage 11 with cap 51 in contact with recording head 9. It is done for a sufficient period of time (here 0.3 seconds) to obtain restoration of the deformed material.

Subsequently, the routine goes to step S503, and after cap 51 has been restored, jetting recovering process by absorbing means is effected. More specifically, absorbing recovering is done with the position of cam unit 63 controlled to absorbing recovery position (c) through driving of recovering system motor 61 by CPU 1000.

Figure 28:
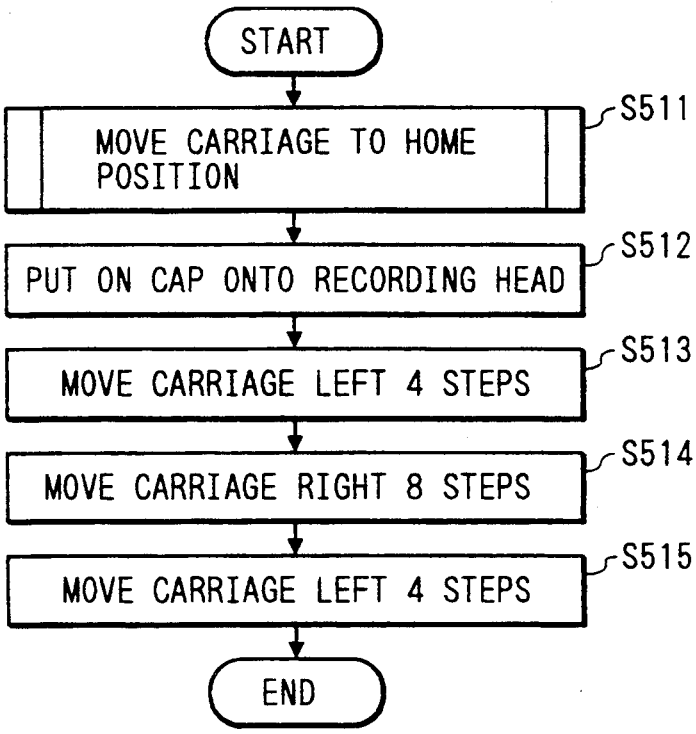

FIG. 28 shows details of step S501 in FIG. 27. More specifically, this flow chart illustrates a routine of capping control for reliably putting cap 51 on the orifice-formed face of recording head 9.

Firstly, in step S511 the position of carriage 11 is detected by carriage home sensor 67, and carriage is moved to the home position. The details of this operation are the same as in the case of FIG. 17 described before in connection with the first embodiment. In subsequent step S512, recovering system motor 61 is driven to put cap 51 on the orifice-formed face of recording head 9. This operation is performed while controlling cam unit 63 from recording operation position (a) to home position (b). At this time, if carriage 11 is found at the home position accurately, projecting and recessed portions 611 and 610 will engage each other. However, if the carriage position is deviated, they fail to engage with each other, and hence cap 51 is not put on the orifice-formed face.

Then, the routine goes to step S513 to move carriage 11 4 steps to the left. Then in step S514 carriage 11 is moved 8 steps to the right. In subsequent step S515 carriage 11 is moved 4 steps to the left. It will be seen that carriage 11 is controlled to swing back and forth with respect to the home position.

With this swinging or rocking control in steps S513 through S515, projecting and recessed portions 611 and 610 which may have been out of engagement in capping control in step S512 are engaged with each other. In this way, cap 51 is put on the orifice-formed face of recording head 9.

In case when projecting and recessed portions 611 and 610 are in engagement with each other, that is, recording head 9 and cap 51 are in engagement with each other, in step S512, cap 51 made of elastic material is tentatively deformed by the rocking control noted above, but it is restored in a predetermined period of time (i.e., about 0.3 seconds here).

As shown above, in this embodiment, when capping recording head 9, carriage 11 is controlled for rocking after the capping operation. Thus, even if there is a deviation from the cap position due to defectiveness or assembling errors in carriage home sensor 67, projecting and recessed portions 611 and 610 can be engaged with each other to let cap 51 reliably engage with recording head 9. It is thus possible to prevent defective jetting that might otherwise occur if the position of ink discharging orifices of recording head 9, i.e., position of carriage 11 carrying the head, and position of cap 51 are deviated from each other.

Further, since projecting and recessed portions 611 and 610 are engaged with each other, even when carriage 11 experiences a shock, it is moved neither in recording nor counter-recording direction, and the capping state is maintained.

Further, since absorbing recovering is done when a predetermined waiting time has been passed after capping, the absorbing is effected after restoration of cap 51 from temporary deformation caused by rocking of carriage 11 with cap 51 in engagement of recording head 9. Thus, there is no possibility of inability of ink absorbing through cap 51 at the time of the absorbing recovering process.

In this third embodiment, wherein in steps S513 through S515 carriage 11 is moved to the left, then to the right and then to the left, the same effects may be obtained by moving the carriage to the right, then to the left and then to the right. Further, in this embodiment the total displacement (assuming the leftward direction to be negative direction) of carriage 11 moved to the left, right and left is made zero, and the carriage is finally moved to the home position. However, if projecting portion 611 of the pump is inserted in recessed portion 610 of carriage 11, carriage 11 is mechanically set to its home position. Therefore, the same effects as in this embodiment may be obtained by moving carriage 11 4 steps to the left and 8 steps to the right or 4 steps to the right and 8 steps to the left.

Further, while the displacement of carriage 11 is set to correspond to 4 steps with respect to the home position, it is varied depending on the construction or gears and so forth in the carriage drive system. It is also varied depending on loads applied to projecting portion 611 of the pump and recessed portion 610 of carriage 11.

Further, while the position of carriage 11 is detected by home position sensor 67 in step S511 in case where the position of carriage 11 is known as during printing, the carriage may be moved to the home position without executing any position detection.

Further, projecting and recessed portions 611 and 610 may have any shape so long as they can lock carriage 11 by engaging with each other.

As has been described in the foregoing, according to the invention reliable capping can be ensured to eliminate defective jetting due to defective capping.

In addition, according to the invention reliable absorbing recovering can be obtained in addition to capping, thus permitting prevention of defective jetting.

The present invention brings about excellent effects particularly in a recording head or recording device of ink jet system utilizing heat energy among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333 and 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing pressure waves of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Furthermore, the form of ink jet recording apparatus according to the invention, in addition to what is used as image output terminal of a data processing apparatus such as a computer, may be those of a copying apparatus combined with a reader or a facsimile apparatus having transmitting and receiving functions.

What is claimed is:

1. A recording apparatus for performing recording on a recording medium with an ink jet recording head for discharging ink, said apparatus comprising:

a cap for covering a face of said recording head, said face of said head being formed with discharging orifices for jetting said ink therefrom;

a stepping motor rotatable according to a supplied exciting phase for driving a carriage carrying said recording head;

detecting means for detecting reaching of a predetermined position by said carriage driven with rotation of said stepping motor;

memory means for storing as a reference exciting phase, a phase with which said stepping motor is excited when a detection signal is provided from said detecting means, every time a recording period starts;

position recognition means for recognizing a position of said carriage, said position recognition means being operable in a first mode for recognizing a position of said carriage through comparison of the exciting phase of said stepping motor and the reference exciting phase stored in said memory means and a second mode for recognizing a position of said carriage not on a basis of said stored reference exciting phase but on a basis of the detection signal; and control means for causing said position recognition means to operate in the first mode during the recording period, and causing said position recognition means to operate in the second mode in a case when said recording head is covered by said cap after the recording period.

2. The recording apparatus according to claim 1, wherein said memory means stores as the reference exciting phase the exciting phase of said stepping motor when the detection signal is provided right before a start of recording.

3. The recording apparatus according to claim 1, further comprising data supply means for supplying recording data to said recording head.

4. The recording apparatus according to claim 3, wherein said control means causes said position recognition means to operate in the second mode and recognize the position of said carriage not on the basis of the stored reference exciting phase when said recording data supplied from said data supply means is data indicative of an end of recording.

5. The recording apparatus according to claim 3, wherein said control means causes said position recognition means to operate in the first mode and recognize the position of said carriage on the basis of the stored reference exciting phase when no said recording data is supplied for a predetermined period of time from said data supply means.

6. The recording apparatus according to claim 3, wherein said data supply means includes a keyboard for inputting the recording data.

7. The recording apparatus according to claim 3, wherein said control means causes said position recognition means to operate in the second mode and recognize the position of said carriage not on a basis of the stored reference exciting phase when no recording data is supplied for a predetermined period of time from said data supply means.

8. The recording apparatus according to claim 3, wherein the recording period starts when said data supply means supplies data indicating a start of recording, and ends when said data supply means supplies data indicating an end of recording.

9. The recording apparatus according to claim 1, wherein said recording apparatus comprises a portable word processor having a keyboard for inputting data and a display screen.

10. The recording apparatus according to claim 1, wherein said cap includes an absorber for absorbing said ink.

11. The recording apparatus according to claim 1, wherein said cap is provided at a position outside a recording zone.

12. The recording apparatus according to claim 11, wherein the predetermined position associated with said detecting means is located between the position of said cap and the recording zone.

13. The recording apparatus according to claim 1, wherein said detecting means comprises a home position sensor for indicating in terms of a voltage level the reaching of the predetermined position by said carriage.

14. The recording apparatus according to claim 1, wherein said recording head includes a plurality of said discharging orifices for jetting said ink therefrom and heat energy generating means provided for each of said discharging orifices for producing a thermal state change of said ink to cause the ink to be jetted from said discharging orifices and thus form flying drops of ink according to the state change.

15. The recording apparatus according to claim 1, wherein said control means causes said position recognition means to operate in the second mode in a case when said recording head is covered by said cap during the recording period.

16. A recording method for performing recording on a recording medium with an ink jet recording head for discharging ink, said method comprising the steps of:

detecting reaching of a predetermined position by a carriage moved with rotation of a stepping motor according to a supplied exciting phase and providing a detection signal;

storing in a memory means as a reference exciting phase, a phase with which the stepping motor is excited when the detection signal is provided, every time a recording period starts;

determining a position of the carriage, said position determining step being executed in one of a first mode in which a position of the carriage is determined through comparison of the exciting phase of the stepping motor and the reference exciting phase stored in the memory means and a second mode in which a position of the carriage is determined not on a basis of the stored reference exciting phase but on a basis of the detection signal;

performing recording on a basis of the position of the carriage determined in the first mode; and capping the recording head on a basis of the position of the carriage determined in the second mode after the recording period.

17. The recording method according to claim 16, wherein in said storing step the memory means stores as the reference exciting phase the exciting phase of the stepping motor when the detection signal is provided right before a start of recording.

18. The recording method according to claim 16, further comprising the step of supplying recording data to the recording head.

19. The recording method according to claim 18, wherein said position determining step is executed in the second mode and determines the position of the carriage not on the basis of the stored reference exciting phase when said recording data supplied in said data supply step is data indicative of an end of recording.

20. The recording method according to claim 18, wherein said position determining step is executed in the first mode and determines the position of the carriage on the basis of the stored reference exciting phase when no said recording data is supplied for a predetermined period of time in said data supply step.

21. The recording method according to claim 18, wherein in said data supply step a keyboard is used for inputting the recording data.

22. The recording method according to claim 18, wherein said position determining step is executed in the second mode and determines the position of the carriage not on a basis of the stored reference exciting phase when no said recording data is supplied for a predetermined period of time in said data supply step.

23. The recording method according to claim 18, wherein the recording period starts when said data supply means supplies data indicating a start of recording, and ends when said data supply means supplies data indicating an end of recording.

24. The recording method according to claim 16, wherein said recording method is usable in a portable word processor having a keyboard for inputting data and a display screen.

25. The recording method according to claim 16, wherein a cap used in said capping step includes an absorber for absorbing said ink.

26. The recording method according to claim 16, wherein a cap used in said capping step is provided at a position outside a recording zone.

27. The recording method according to claim 26, wherein the predetermined position associated with said detecting step is located between the position of the cap and the recording zone.

28. The recording method according to claim 16, wherein in said detecting step a home position sensor is used for indicating in terms of a voltage level the reaching of the predetermined position by the carriage.

29. The recording method according to claim 16, wherein the recording head includes a plurality of discharging orifices for jetting said ink therefrom and heat energy generating means provided for each of said discharging orifices for producing a thermal state change of said ink to cause the ink to be jetted from the discharging orifices and thus form flying drops of said ink according to the state change.

30. The recording method according to claim 16, wherein in said capping step the recording head is capped on a basis of the position of the carriage determined in the second mode during the recording period.

* * * * *